US007896066B2

(12) United States Patent
Higashiyama

(10) Patent No.: US 7,896,066 B2
(45) Date of Patent: Mar. 1, 2011

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 892 days.

(21) Appl. No.: 11/813,561

(22) PCT Filed: Jan. 18, 2006

(86) PCT No.: PCT/JP2006/301083

§ 371 (c)(1),
(2), (4) Date: Jul. 9, 2007

(87) PCT Pub. No.: WO2006/078048

PCT Pub. Date: Jul. 27, 2006

(65) Prior Publication Data

US 2009/0007592 A1 Jan. 8, 2009

Related U.S. Application Data

(60) Provisional application No. 60/645,612, filed on Jan. 24, 2005.

(30) Foreign Application Priority Data

Jan. 18, 2005 (JP) ..... 2005-010213

(51) Int. Cl.
*F28F 9/02* (2006.01)
*F28D 7/06* (2006.01)

(52) U.S. Cl. ..... 165/174; 165/176

(58) Field of Classification Search ..... 165/174, 165/153, 175, 176, 182, 183
See application file for complete search history.

(56) References Cited

U.S. PATENT DOCUMENTS

| | | | | |
|---|---|---|---|---|
| 5,348,081 | A * | 9/1994 | Halstead et al. | 165/144 |
| 6,272,881 | B1 * | 8/2001 | Kuroyanagi et al. | 62/525 |
| 6,328,100 | B1 * | 12/2001 | Haussmann | 165/176 |
| 6,742,577 | B2 * | 6/2004 | Joboji et al. | 165/153 |
| 2002/0020521 | A1 * | 2/2002 | Hoshino et al. | 165/174 |
| 2004/0159121 | A1 * | 8/2004 | Horiuchi et al. | 62/526 |
| 2004/0200606 | A1 * | 10/2004 | Higashiyama | 165/153 |
| 2005/0126770 | A1 | 6/2005 | Higashiyama | |
| 2007/0158057 | A1 | 7/2007 | Higashiyama | |

FOREIGN PATENT DOCUMENTS

| | | |
|---|---|---|
| BR | 0210482 | 8/2004 |
| CN | 1516799 A | 7/2004 |
| CN | 1526063 A | 9/2004 |
| CN | 1545608 A | 11/2004 |

(Continued)

*Primary Examiner* — Tho v Duong
(74) *Attorney, Agent, or Firm* — Oblon, Spivak, McClelland, Maier & Neustadt, L.L.P.

(57) ABSTRACT

A heat exchanger includes a heat exchanger core section, a refrigerant inlet header section, a refrigerant outlet header section, a refrigerant inflow intermediate header section and a refrigerant outflow intermediate header section. A flow-dividing control wall having a plurality of refrigerant passage holes and vertically dividing the interior of the second intermediate header section into two spaces is provided within the second intermediate header section. A communication is established between the first intermediate header section and the lower space of the second intermediate header section at one end. A guide portion is provided at a refrigerant inflow end portion of the second intermediate header section so as to guide the refrigerant flowing into the lower space of the second intermediate header section such that the refrigerant flows toward the flow-dividing control wall; i.e., toward the upper side.

17 Claims, 10 Drawing Sheets

FOREIGN PATENT DOCUMENTS

| | | | | |
|---|---|---|---|---|
| CS | 20033356 | | | 11/2004 |
| EP | 1 373 821 | A1 | | 1/2004 |
| EP | 1 397 623 | A1 | | 3/2004 |
| EP | 1 409 943 | A1 | | 4/2004 |
| JP | 03134494 | A | * | 6/1991 |
| JP | 7-149135 | | | 6/1995 |
| JP | 7 149135 | | | 6/1995 |
| JP | 9-273830 | | | 10/1997 |
| JP | 9 273830 | | | 10/1997 |
| JP | 2002-340495 | | | 11/2002 |
| JP | 2002 340495 | | | 11/2002 |
| JP | 2003 14392 | | | 1/2003 |
| JP | 2003-14392 | | | 1/2003 |
| JP | 2003 75024 | | | 3/2003 |
| JP | 2003-75024 | | | 3/2003 |
| JP | 2003-214794 | | | 7/2003 |
| TW | 552382 | B | | 9/2003 |
| TW | 554162 | B | | 9/2003 |
| WO | WO 02/073114 | A1 | | 9/2002 |
| WO | WO 02/103263 | A1 | | 12/2002 |
| WO | WO 03/002926 | A1 | | 1/2003 |

* cited by examiner

HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/645,612 filed Jan. 24, 2005 pursuant to 35 U.S.C. §111(b).

TECHNICAL FIELD

The present invention relates to a heat exchanger, and more particularly, to a heat exchanger preferably used as an evaporator of a car air conditioner, which is a refrigeration cycle to be mounted on, for example, an automobile.

Herein and in the appended claims, the downstream side of an air flow (a side represented by arrow X in FIGS. 1 and 11, and a right-hand side in FIG. 3) is referred to as the "front," and the opposite side as the "rear." The upper and lower sides of FIG. 2 will be referred to as "upper" and "lower," respectively.

BACKGROUND ART

Conventionally, a so-called laminated evaporator has been widely employed as an evaporator for use in a car air conditioner. In the laminated evaporator, a plurality of flat, hollow members, each of which includes a pair of depressed plates facing each other and brazed to each other at their peripheral edge portions, are arranged in parallel, and corrugate fins are each disposed between and brazed to the adjacent flat, hollow members.

In recent years, evaporators have been required to be further reduced in size and weight and to exhibit higher performance. A known evaporator which fulfills these requirements includes a heat exchange core section configured such that heat exchange tube groups are arranged in two rows in the front-rear direction, each heat exchange tube group consisting of a plurality of heat exchange tubes arranged at predetermined intervals; a refrigerant inlet header section which are disposed on the upper-end side of the heat exchange tubes and to which the left half of the heat exchange tubes of the front heat exchange tube group are connected; a refrigerant outlet header section which is disposed on the upper-end side of the heat exchange tubes to be located on the rear side of the refrigerant inlet header section and to which the left half of the heat exchange tubes of the rear heat exchange tube group are connected; a first intermediate header section which is disposed on the lower-end side of the heat exchange tubes and to which the heat exchange tubes of the heat exchange tube group connected to the refrigerant inlet header section are connected; a second intermediate header section which is disposed on the right side of the first intermediate header section and to which the remaining heat exchange tubes of the front heat exchange tube group are connected; a third intermediate header section which is disposed on the upper-end side of the heat exchange tubes to be located on the right side of the refrigerant inlet header section and to which the heat exchange tubes connected to the second intermediate header section are connected; a fourth intermediate header section which is disposed on the upper-end side of the heat exchange tubes to be located on the rear side of the third intermediate header section and to which the remaining heat exchange tubes of the rear heat exchange tube group are connected; a fifth intermediate header section which is disposed on the lower-end side of the heat exchange tubes to be located on the rear side of the second intermediate header section and to which the heat exchange tubes connected to the fourth intermediate header section are connected; and a sixth fifth intermediate header section which is disposed on the lower-end side of the heat exchange tubes to be located on the left side of the fifth intermediate header section and to which the heat exchange tubes connected to the refrigerant outlet header section are connected. Refrigerant which flows into the refrigerant inlet header section passes through the heat exchange tubes and the first through sixth header sections, flows into the refrigerant outlet header section, and then flows out of the refrigerant outlet header section (refer to Japanese Patent Application Laid-Open (kokai) No. 2003-214794).

In the evaporator disclosed in the publication, the first intermediate header section and the second intermediate header section are integrally provided in a single header section, the fifth intermediate header section and the sixth intermediate header section are integrally provided in a single header section, and refrigerant flows into the second intermediate header section and the sixth intermediate header section from their longitudinal end portions.

However, in the evaporator disclosed in the publication, refrigerant having flown into the second intermediate header section or the sixth intermediate header section tends to flow toward the deeper side within the intermediate header section, and becomes less likely to flow into heat exchange tubes connected to the refrigerant inflow side of the intermediate header section. As a result, refrigerant becomes less likely to uniformly flow into all the heat exchange tubes connected to both the intermediate header sections. Therefore, the distribution of refrigerant within the heat exchange core section becomes non-uniform, and the temperature of air having passed through the heat exchange core section becomes non-uniform in some locations, so that the heat exchange performance is not improved sufficiently.

An object of the present invention is to overcome the above problem and to provide a heat exchanger which exhibits excellent heat exchange performance.

DISCLOSURE OF THE INVENTION

To achieve the above object, the present invention comprises the following modes.

1) A heat exchanger comprising a refrigerant inlet header section and a refrigerant outlet header section which are arranged in parallel in a front-rear direction, and a refrigerant circulation passage for establishing communication between the header sections, wherein the refrigerant circulation passage is composed of a plurality of intermediate header sections and a plurality of heat exchange tubes; the refrigerant inlet header section faces a first intermediate header section; the refrigerant outlet header section faces a second intermediate header section; at least a single heat exchange tube group composed of a plurality of heat exchange tubes disposed at intervals is disposed between the refrigerant inlet header section and the first intermediate header section and between the refrigerant outlet header section and the second intermediate header section; opposite end portions of the heat exchange tubes of each heat exchange tube group are connected to the corresponding header sections facing each other; refrigerant flowing into the refrigerant inlet header section passes through the refrigerant circulation passage, and returns to the refrigerant outlet header section to be fed out from the refrigerant outlet header section; and the refrigerant flows into at least one intermediate header section from its one longitudinal end, wherein a guide portion is provided at a refrigerant-inflow-side end portion of the intermediate header section into which refrigerant flows from the longitudinal end thereof, so as to guide the refrigerant flowing into the intermediate header section to flow upward.

2) A heat exchanger according to par. 1), comprising a heat exchange core section configured such that heat exchange tube groups each consisting of a plurality of heat exchange tubes arranged at intervals are arranged in a plurality of rows in the front-rear direction, wherein the refrigerant inlet header section is disposed on a first-end side of the heat exchange tubes, and the heat exchange tubes of at least one heat exchange tube group are connected to the refrigerant inlet header section; the refrigerant outlet header section is disposed on the first-end side of the heat exchange tubes to be located rearward of the refrigerant inlet header section, and the heat exchange tubes of the remaining heat exchange tube group(s) are connected to the refrigerant outlet header section; the first intermediate header section is disposed on a second-end side of the heat exchange tubes, and the heat exchange tubes connected to the refrigerant inlet header section are connected to the first intermediate header section; the second intermediate header section is disposed on the second-end side of the heat exchange tubes to be located rearward of the first intermediate header section, and the heat exchange tubes connected to the refrigerant outlet header section are connected to the second intermediate header section; communication is established between the first intermediate header section and the second intermediate header section at their ends; the refrigerant is caused to flow into the second intermediate header section from an end portion thereof which communicates with the first intermediate header section; and the guide portion for guiding the refrigerant flowing into the second intermediate header section to flow upward is provided at the refrigerant-inflow-side end portion of the second intermediate header section.

3) A heat exchanger according to par. 2), wherein flow-dividing control means having a refrigerant passage hole and vertically dividing the interior of the second intermediate header section into first and second spaces is provided within the second intermediate header section; the heat exchange tubes connected to the second intermediate header section face the first space; communication is established between the first intermediate header section and the second space of the second intermediate header section; and the guide portion provided at the refrigerant-inflow-side end portion of the second intermediate header section guides the refrigerant flowing into the second space of the second intermediate header section to flow upward.

4) A heat exchanger according to par. 3), wherein a plurality of refrigerant passage holes are formed in the flow-dividing control means at intervals with respect to the longitudinal direction of the second intermediate header section.

5) A heat exchanger according to par. 4), wherein the refrigerant passage holes are formed in the flow-dividing control means to be located on the rear side of a central portion with respect to the front-rear direction.

6) A heat exchanger according to par. 2), wherein the refrigerant inlet header section and the refrigerant outlet header section are disposed on the upper-end side of the heat exchange tubes, and the first and second intermediate header sections are disposed on the lower-end side of the heat exchange tubes.

7) A heat exchanger according to par. 2), wherein each of the first and second header sections has caps for closing the opposite ends thereof; a refrigerant outflow opening is formed in the cap at one end of the first intermediate header section; a refrigerant inflow opening is formed in the cap at one end of the second intermediate header section; and communication is established between the refrigerant outflow opening and the refrigerant inflow opening via a communication member, whereby the two intermediate header sections communicate with each other at their ends.

8) A heat exchanger according to par. 7), wherein the guide portion is provided at a portion of a circumferential edge portion of the refrigerant inflow opening formed in the cap at the end of the second intermediate header section such that the guide portion extends toward the interior of the second intermediate header section while inclining or curving upward.

9) A heat exchanger according to par. 8), wherein the guide portion extends toward the interior of the second intermediate header section while curving upward, and the guide portion has an arcuate portion which extends toward the interior of the second intermediate header section while curving upward, in a cross section taken along a vertical plane extending along the longitudinal direction of the second intermediate header section.

10) A heat exchanger according to par. 7), wherein the cap of the first intermediate header section in which the refrigerant inflow opening is formed and the cap of the second intermediate header section in which the refrigerant outflow opening is formed are integrated with each other, and the communication member is fixed to the caps such that the communication member extends over both the caps.

11) A heat exchanger according to par. 2), wherein a refrigerant inlet is formed at one end portion of the refrigerant inlet header section, and a refrigerant out is formed at an end portion of the refrigerant outlet header section to be located on the same side as the end portion where the refrigerant inlet is formed.

12) A heat exchanger according to par. 11), wherein the interior of the refrigerant outlet header section is vertically divided into first and second spaces by partitioning means; the heat exchange tubes are connected to the refrigerant outlet header section to face the first space; a refrigerant passage hole is formed in the partitioning means; and the second space of the refrigerant outlet header section communicates with the refrigerant outlet.

13) A heat exchanger according to par. 1), wherein the heat exchange tubes are each in a flat form and are arranged such that their widths extend in the front-rear direction, and a tube height, which is a thickness of the individual heat exchange tubes, is 0.75 mm to 1.5 mm.

14) A heat exchanger according to par. 1), wherein a fin is disposed between adjacent heat exchange tubes; the fin is in a corrugate form and comprises wave crest portions, wave trough portions, and flat connection portions connecting together the wave crest portions and the wave trough portions; and the fin has a fin height of 7.0 mm to 10.0 mm and a fin pitch of 1.3 mm to 1.7 mm.

15) A heat exchanger according to par. 14), wherein each of the wave crest portions and the wave trough portions of the corrugate fin comprises a flat portion, and round portions located at corresponding opposite ends of the flat portion and connected to the corresponding connection portions; and the round portions have a radius of curvature of 0.7 mm or less.

According to the heat exchanger of par. 1), the guide portion is provided at a refrigerant-inflow-side end portion of an intermediate header section into which refrigerant flows from the longitudinal end thereof, so as to guide the refrigerant flowing into the intermediate header section to flow upward. Therefore, the heat exchanger achieves the following effects. That is, in the case where the intermediate header section is disposed on the lower side, the refrigerant flowing into the intermediate header section is guided by the guide portion to flow toward the heat exchange tubes. Therefore, it becomes easier for the refrigerant to flow into the heat exchange tubes connected to the refrigerant inflow side portion of the intermediate header section, so that the refrigerant becomes more likely to uniformly flow into the heat exchange tubes connected to the intermediate header section. In the case where the intermediate header section is disposed on the upper side, the refrigerant flowing into the intermediate header section is guided by the guide portion to flow upward. Therefore, it becomes easier for the refrigerant to flow into the heat exchange tubes located away from the refrigerant-inflow-side end portion of the intermediate header section, so that the refrigerant becomes more likely to uniformly flow into the heat exchange tubes connected to the intermediate header section. Therefore, in either case, the distribution of refrigerant in the heat exchange core section is less likely to become non-uniform, and the temperature of air having passed through the heat exchange core section becomes uniform, whereby the heat exchange performance is improved.

According to the heat exchanger of par. 2), the guide portion is provided at a refrigerant-inflow-side end portion of the second intermediate header section so as to guide the refrigerant flowing into the second intermediate header section to flow upward. Therefore, the heat exchanger achieves the following effects. That is, in the case where the second intermediate header section is disposed on the lower side, the refrigerant flowing into the second intermediate header section is guided by the guide portion to flow toward the heat exchange tubes. Therefore, it becomes easier for the refrigerant to flow into the heat exchange tubes connected to the refrigerant inflow side portion of the second intermediate header section, so that the refrigerant becomes more likely to uniformly flow into the heat exchange tubes connected to the second intermediate header section. In the case where the second intermediate header section is disposed on the upper side, the refrigerant flowing into the second intermediate header section is guided by the guide portion to flow upward. Therefore, it becomes easier for the refrigerant to flow into the heat exchange tubes located away from the refrigerant inflow side portion of the second intermediate header section, so that the refrigerant becomes more likely to uniformly flow into the heat exchange tubes connected to the second intermediate header section. Therefore, in either case, the distribution of refrigerant in the heat exchange core section is less likely to become non-uniform, and the temperature of air having passed through the heat exchange core section becomes uniform, whereby the heat exchange performance is improved.

According to the heat exchanger of any one of pars. 3 to 5), in the case where the second intermediate header section is disposed on the lower side, the refrigerant flowing into the second space of the second intermediate header section is guided toward the flow-dividing control means by means of the guide portion, passes through the refrigerant passage holes, flows into the first space, and then flows into the heat exchange tubes. In the case where the second intermediate header section is disposed on the upper side, the refrigerant flowing into the second space of the second intermediate header section is guided upward by means of the guide portion, passes through the refrigerant passage holes of the flow-dividing control means, flows into the first space, and then flows into the heat exchange tubes. Therefore, in either case, if the refrigerant passage holes are formed in the flow-dividing control means at positions suitable for producing uniform divided flows toward the heat exchange tubes connected to the second intermediate header portion, the refrigerant becomes more likely to uniformly flow into the heat exchange tubes connected to the second intermediate header portion. As a result, the distribution of refrigerant in the heat exchange core section is less likely to become non-uniform, and the temperature of air having passed through the heat exchange core section becomes uniform, whereby the heat exchange performance is improved.

According to the heat exchanger of par. 6), the refrigerant flowing into the second space of the second intermediate header section is guided toward the flow-dividing control means by means of the guide portion, passes through the refrigerant passage holes, flows into the first space, and then flows into the heat exchange tubes. Therefore, if the refrigerant passage holes are formed in the flow-dividing control means at positions suitable for producing uniform divided flows toward the heat exchange tubes connected to the second intermediate header portion, the refrigerant becomes more likely to uniformly flow into the heat exchange tubes connected to the second intermediate header portion. As a result, the distribution of refrigerant in the heat exchange core section is less likely to become non-uniform, and the temperature of air having passed through the heat exchange core section becomes uniform, whereby the heat exchange performance is improved.

According to the heat exchanger of par. 7), communication between the first intermediate header section and the second intermediate header section can be established by a relatively simple structure.

According to the heat exchanger of par. 8) or 9), the guide portion can be formed in a relatively simple manner.

According to the heat exchanger of par. 10), the caps of the two intermediate header sections are integrated with each other. Therefore, the number of components can be reduced, and communication between the first intermediate header section and the second intermediate header section can be established by a relatively simple structure.

According to the heat exchanger of par. 13) or 14), it is possible to improve the heat exchange performance while suppressing an increase in air flow resistance, in a well balanced manner.

BEST MODE FOR CARRYING OUT THE INVENTION

An embodiment of the present invention will next be described in detail with reference to the drawings. In the embodiment which will be described below, a heat exchanger according to the present invention is applied to an evaporator of a car air conditioner using a chlorofluorocarbon-based refrigerant.

In the following description, the term "aluminum" encompasses aluminum alloys in addition to pure aluminum. Further, in the following description, the left-hand and right-hand sides of FIG. 2 will be referred to as "left" and "right," respectively.

Figure 1:
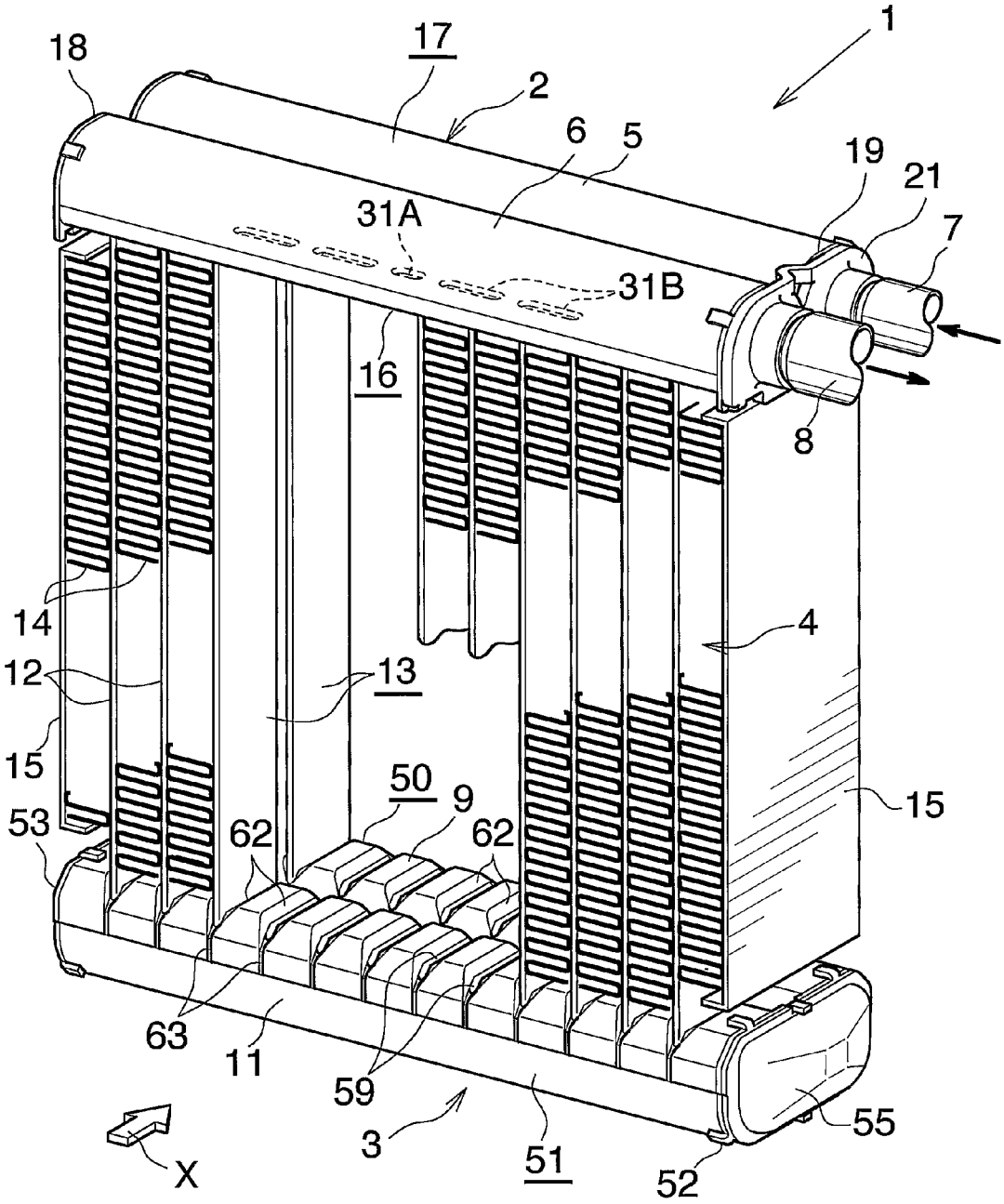
FIG. 1 is a partially cut-away perspective view showing the overall configuration of an evaporator to which a heat exchanger according to the present invention is applied.
Figure 2:
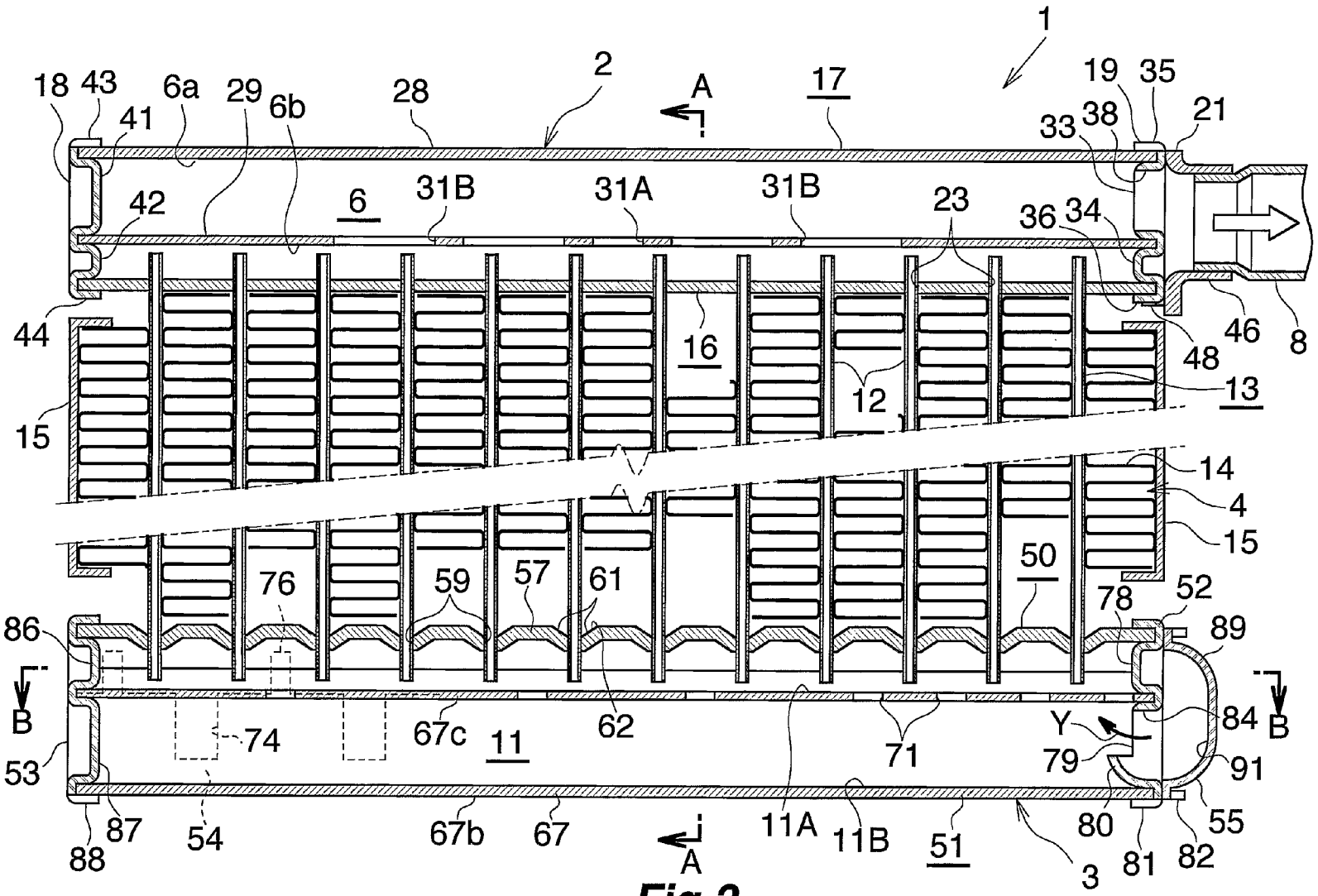
FIG. 2 is a fragmentary view in vertical section showing the evaporator shown in FIG. 1 as it is seen from the rear, with its intermediate portion omitted.
Figure 3:
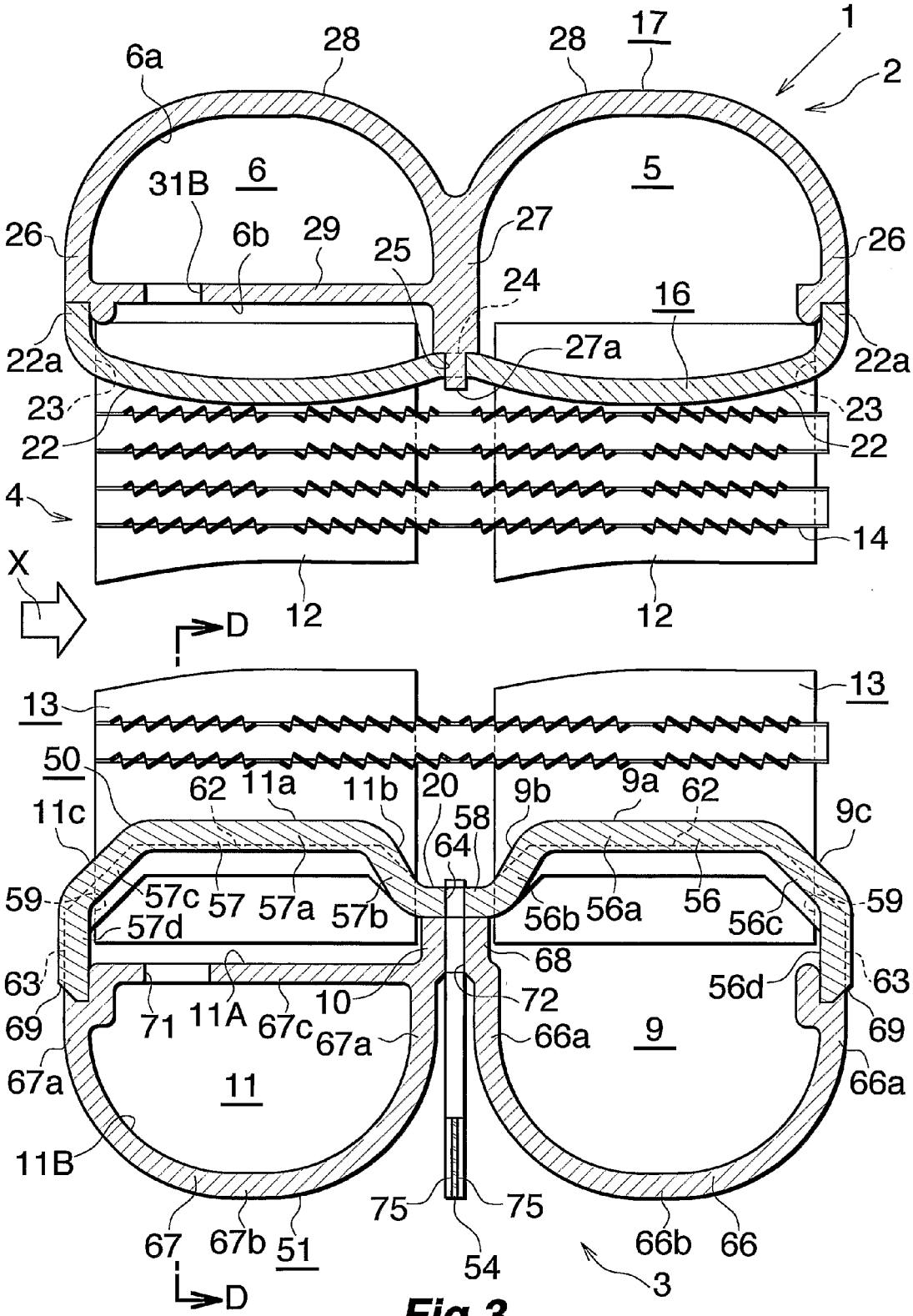
FIG. 3 is an enlarged fragmentary view in section taken along line A-A of FIG. 2.
Figure 11:
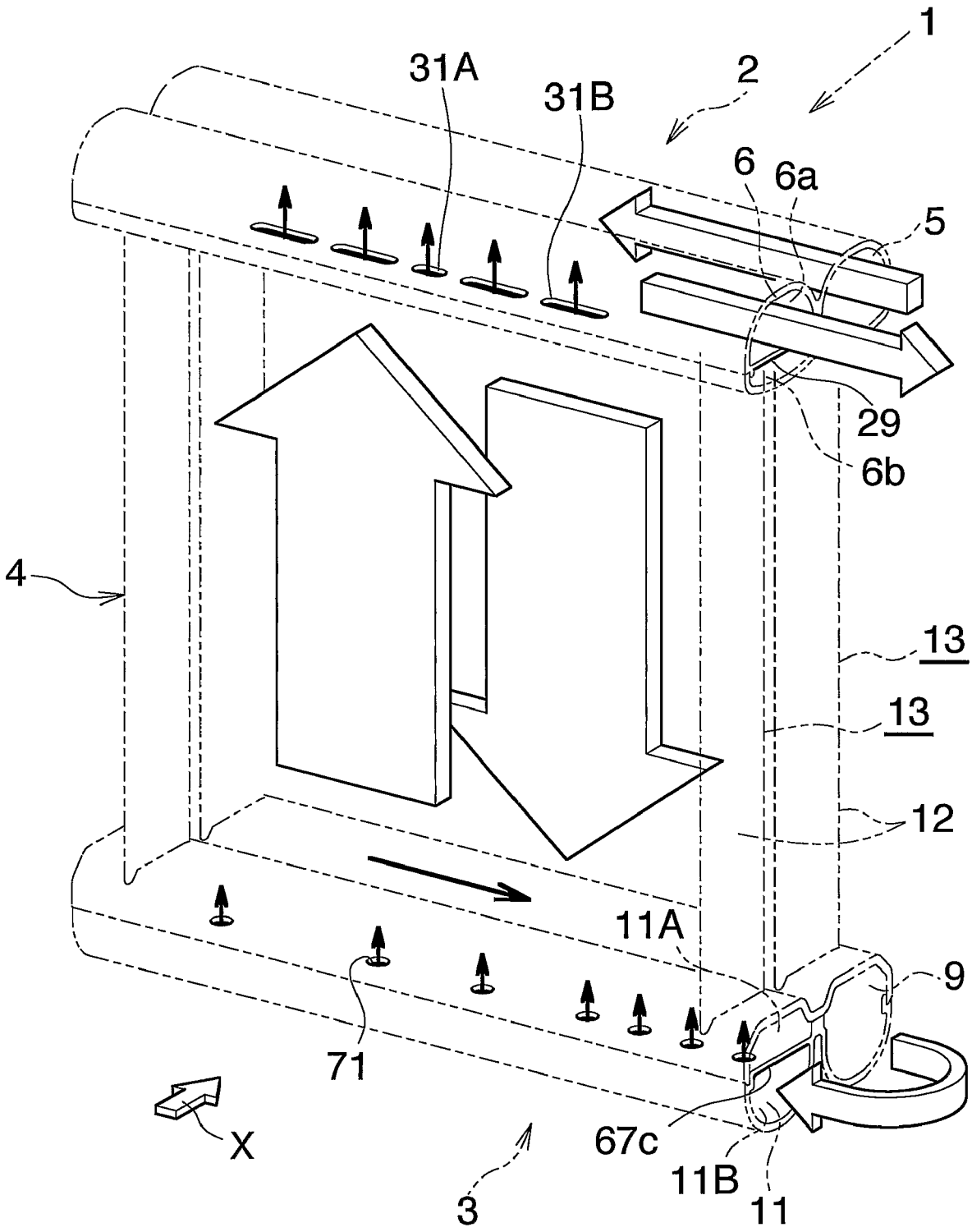
FIG. 11 is a diagram showing the flow of a refrigerant in the evaporator shown in FIG. 1.

FIGS. 1 to 3 show the overall configuration of an evaporator, and FIGS. 4 to 10 show the configuration of essential portions of the evaporator. FIG. 11 shows how a refrigerant flows in the evaporator.

In FIGS. 1 to 3, the evaporator (1), which is used in a car air conditioner using a chlorofluorocarbon-based refrigerant, includes a refrigerant inlet/outlet tank (2) made of aluminum and a refrigerant turn tank (3) made of aluminum, the tanks (2) and (3) being vertically spaced apart from each other, and further includes a heat exchange core section (4) provided between the tanks (2) and (3).

The refrigerant inlet/outlet tank (2) includes a refrigerant inlet header section (5) located on a side toward the front (downstream side with respect to the air flow direction) and a refrigerant outlet header section (6) located on a side toward the rear (upstream side with respect to the air flow direction). The header sections (5) and (6) are integrated with each other via connection means, which will be described later. A refrigerant inlet pipe (7) made of aluminum is connected to the refrigerant inlet header section (5) of the refrigerant inlet/outlet tank (2). A refrigerant outlet pipe (8) made of aluminum is connected to the refrigerant outlet header section (6).

The refrigerant turn tank (3) includes a refrigerant inflow intermediate header section (9) (first intermediate header section) located on the side toward the front and a refrigerant outflow intermediate header section (11) (second intermediate header section) located on the side toward the rear. A connection section (10) connects the header sections (9) and (11) together for integration. The header sections (9) and (11) and the connection section (10) define a drain gutter (20) (see FIG. 3).

The heat exchange core section (4) is configured such that heat exchange tube groups (13) are arranged in a plurality of; herein, two, rows in the front-rear direction, each heat exchange tube group (13) consisting of a plurality of heat exchange tubes (12) arranged in parallel at predetermined intervals in the left-right direction and such that corrugate fins (14) are disposed within corresponding air-passing clearances between the adjacent heat exchange tubes (12) of the heat exchange tube groups (13) and on the outer sides of the leftmost and rightmost heat exchange tubes (12) of the heat exchange tube groups (13), and are brazed to the corresponding heat exchange tubes (12). Side plates (15) made of aluminum are disposed on the outer sides of the leftmost and rightmost corrugate fins (14), and are brazed to the corresponding corrugate fins (14). The upper and lower ends of the heat exchange tubes (12) of the front heat exchange tube group (13) are connected to the refrigerant inlet header section (5) and the refrigerant inflow intermediate header section (9), respectively, whereby the heat exchange tubes (12) form a forward refrigerant flow section. The upper and lower ends of the heat exchange tubes (12) of the rear heat exchange tube group (13) are connected to the refrigerant outlet header section (6) and the refrigerant outflow intermediate header section (11), respectively, whereby the heat exchange tubes (12) form a return refrigerant flow section.

Figure 4:
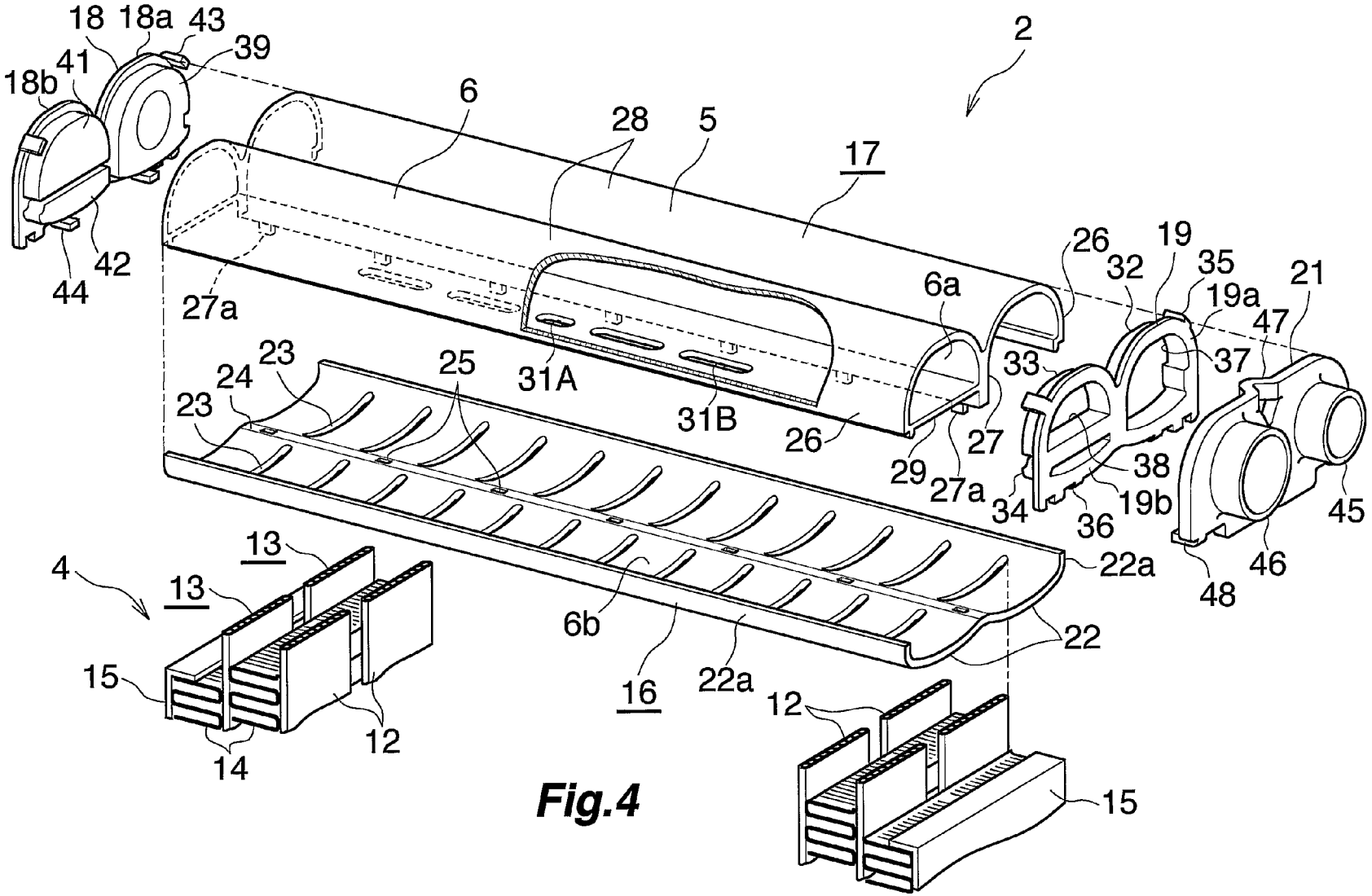
FIG. 4 is an exploded perspective view of a refrigerant inlet/outlet tank of the evaporator shown in FIG. 1.
Figure 5:
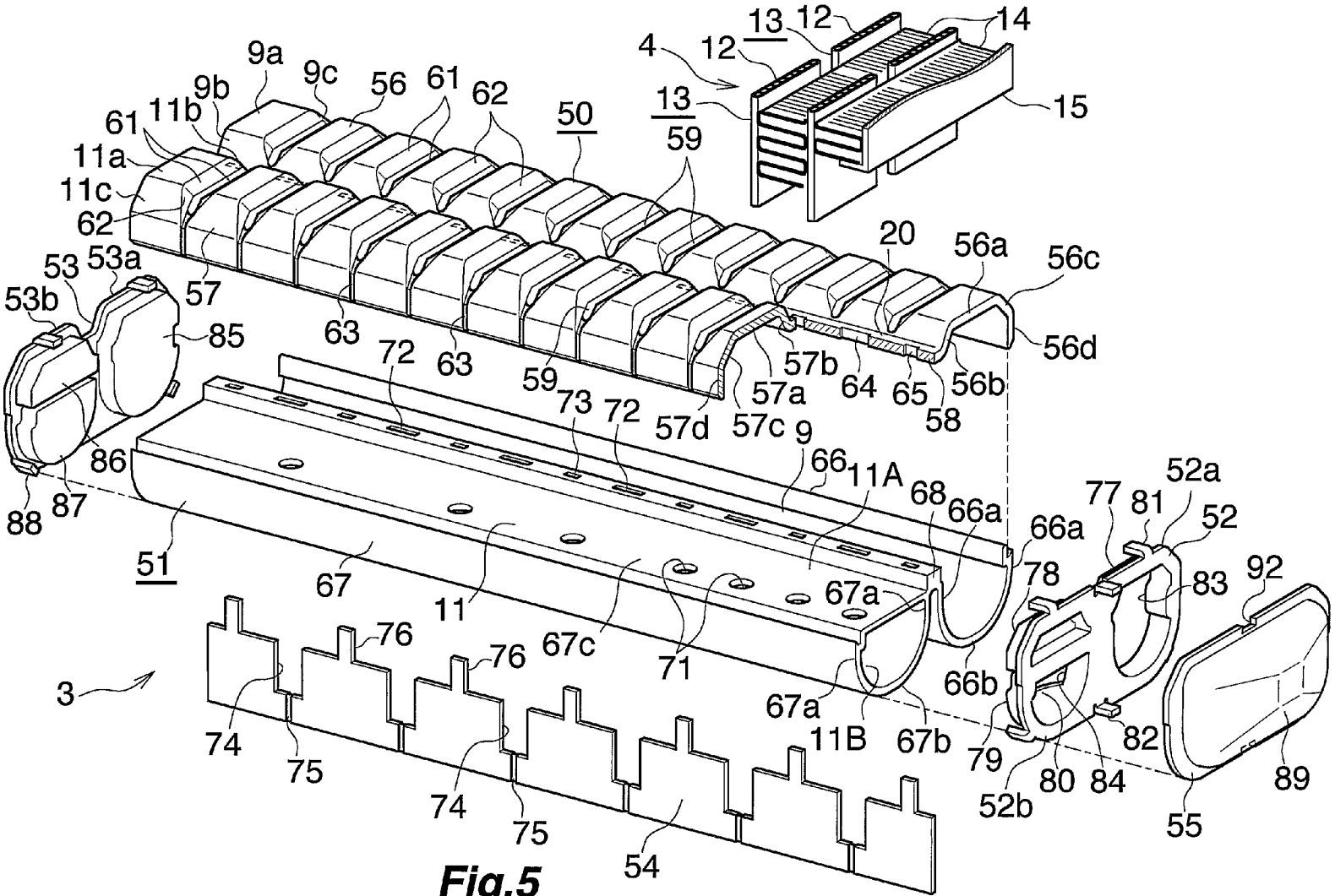
FIG. 5 is an exploded perspective view of a refrigerant turn tank of the evaporator shown in FIG. 1.
Figure 6:
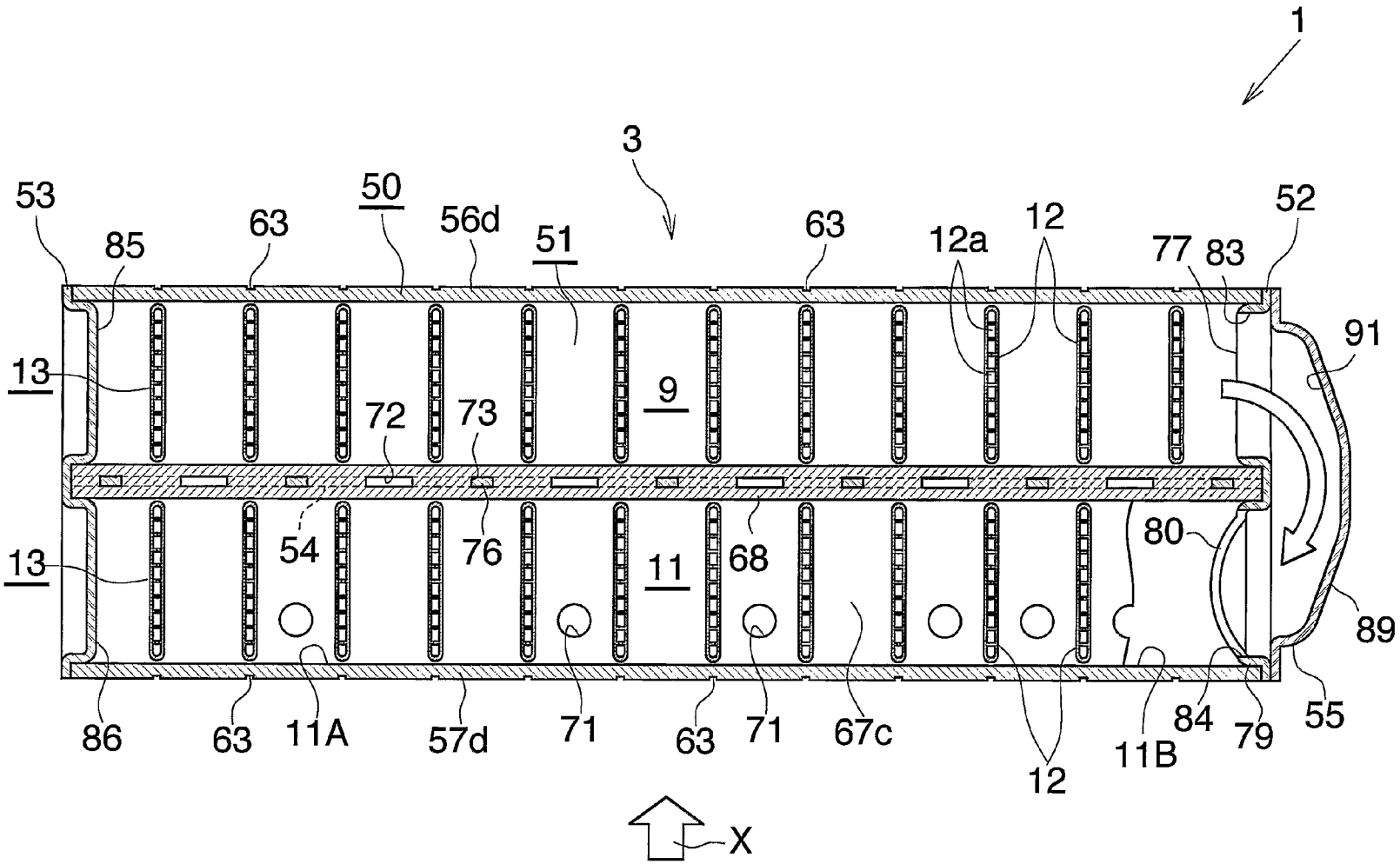
FIG. 6 is a sectional view taken along line B-B of FIG. 2.
Figure 7:
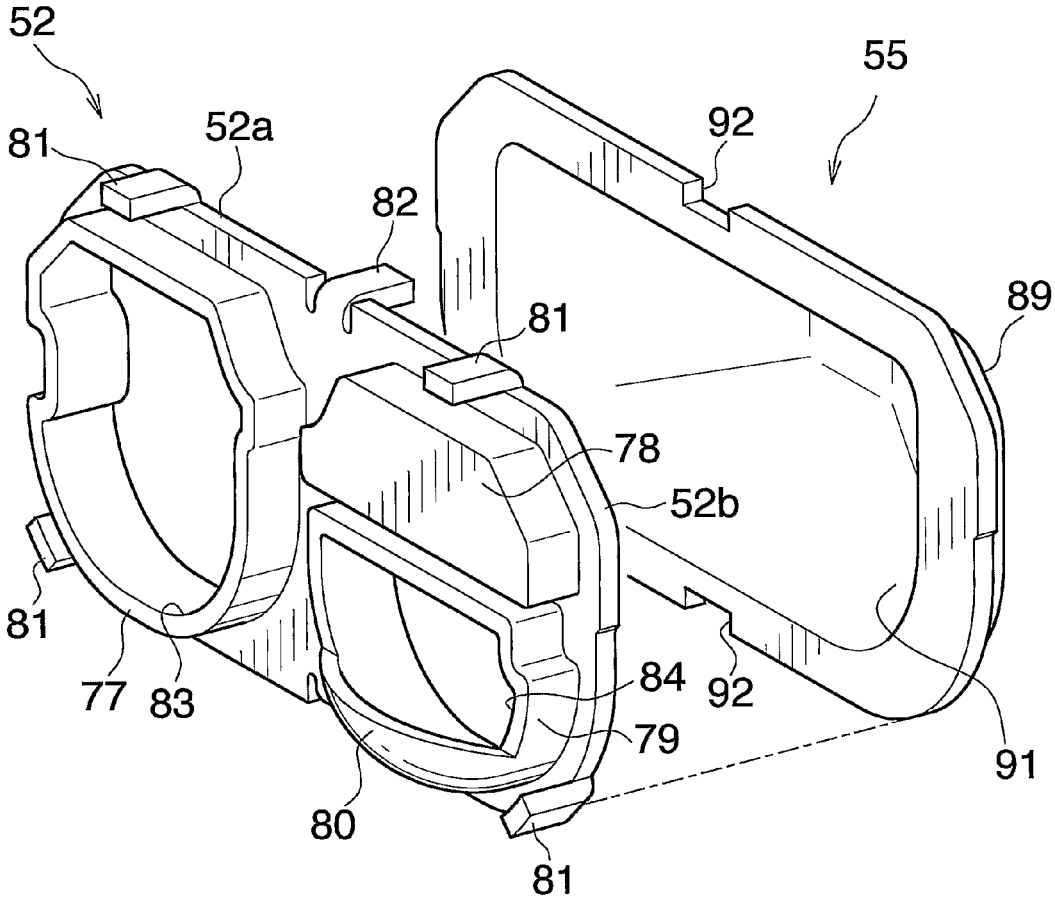
FIG. 7 is an enlarged perspective view showing a right-hand closing member and a communication member of the refrigerant turn tank.
Figure 8:
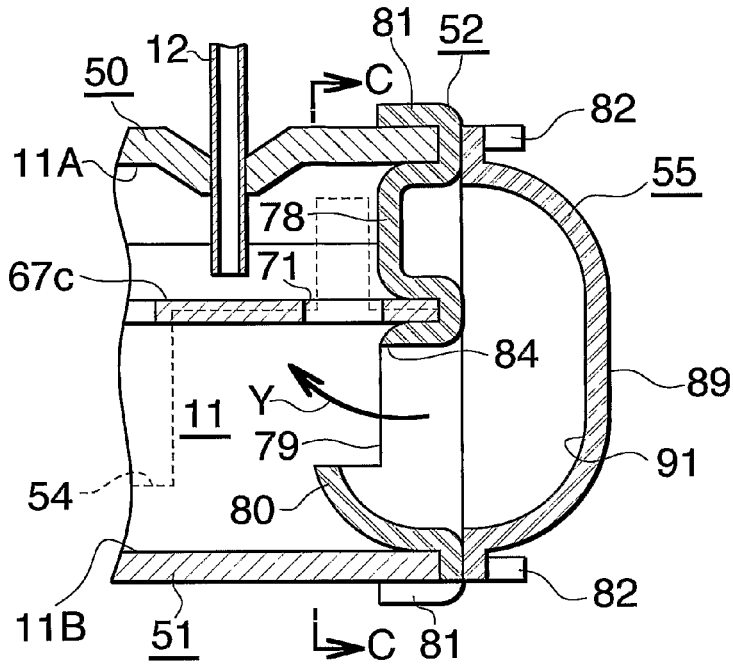
FIG. 8 is a partial enlarged view of FIG. 2.
Figure 9:
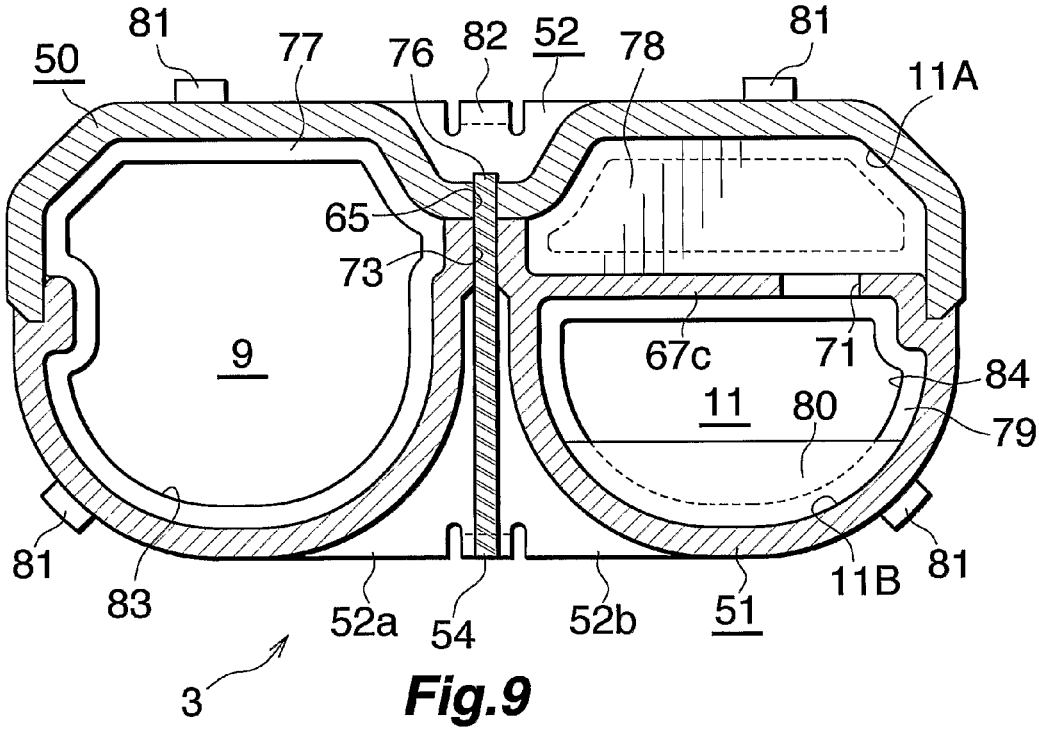
FIG. 9 is a sectional view taken along line C-C of FIG. 8.
Figure 10:
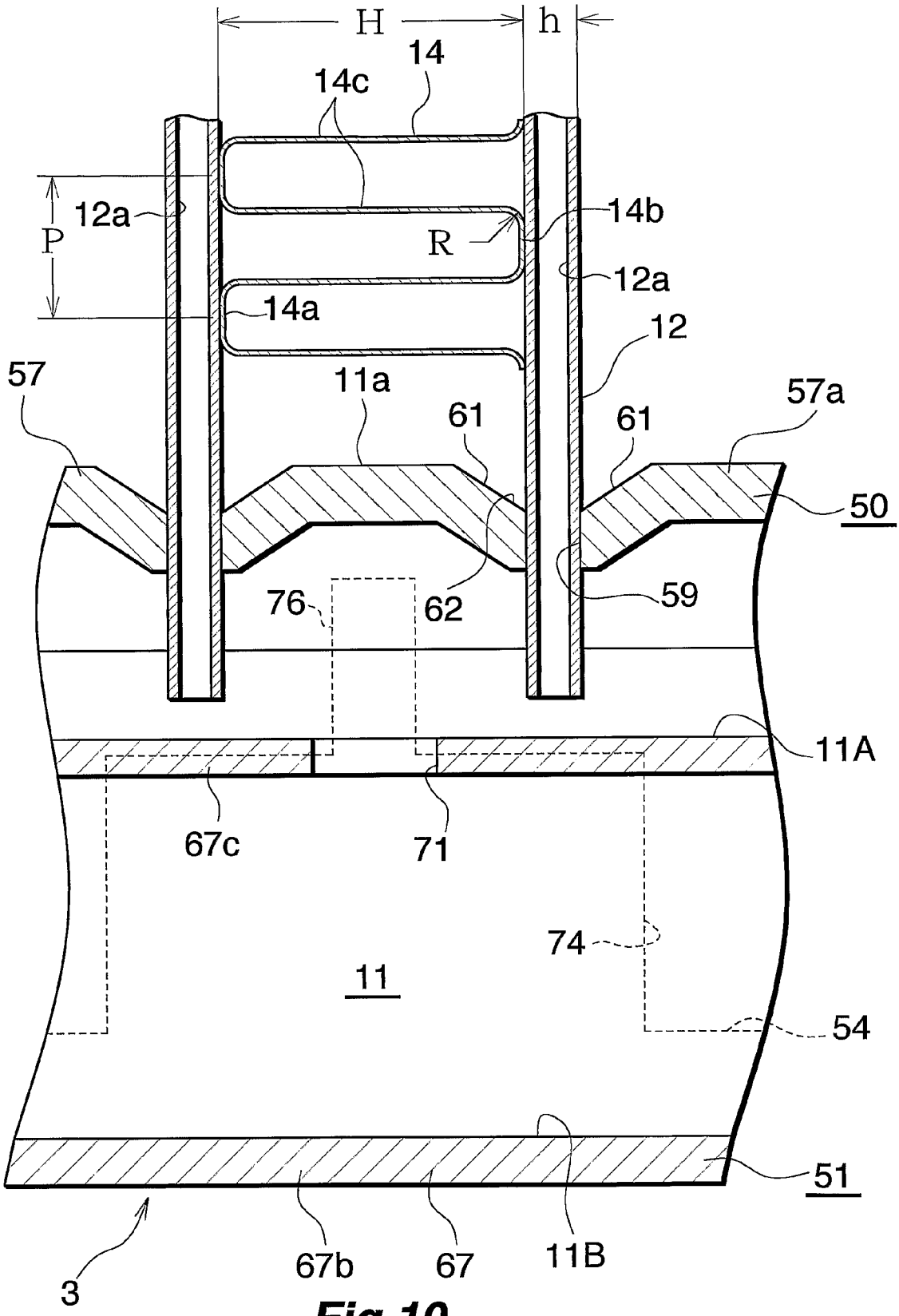
FIG. 10 is an enlarged fragmentary view in section taken along line D-D of FIG. 3.

As shown in FIGS. 3 and 4, the refrigerant inlet/outlet tank (2) is formed from an aluminum brazing sheet having a brazing material layer on each of opposite sides thereof, and includes a first member (16) having a plate-like shape and to which all the heat exchange tubes (12) are connected; a second member (17) formed from a bare aluminum extrudate and covering the upper side of the first member (16); and closing members (18) and (19) formed from an aluminum brazing sheet having a brazing material layer on each of opposite sides thereof, and joined to the opposite ends of the first and second members (16) and (17) to thereby close the left and right end openings of a hollow body formed by the first and second members (16) and (17). A joint plate (21) made of aluminum and elongated in the front-rear direction is brazed to the outer surface of the right-hand closing member (19) while facing the respective ends of the refrigerant inlet header section (5) and the refrigerant outlet header section (6). The refrigerant inlet pipe (7) and the refrigerant outlet pipe (8) are connected to the joint plate (21).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A flat portion (24), which serves as means for connecting together the refrigerant inlet header section (5) and the refrigerant outlet header section (6), is formed between the curved portions (22) of the first member (16). A plurality of through holes (25) are formed in the flat portion (24) at predetermined intervals in the left-right direction.

The second member (17) has a cross section resembling the letter m, which opens downward, and includes front and rear walls (26) extending in the left-right direction; a partition wall (27) (partition means) provided at a central region thereof between the front and rear walls (26), extending in the left-right direction, and dividing the interior of the refrigerant inlet/outlet tank (2) into a front space and a rear space; and two substantially arcuate connection walls (28) projecting upward and integrally connecting the upper end of the partition wall (27) and the upper ends of the front and rear walls (26). The partition wall (27) serves as means for connecting together the refrigerant inlet header section (5) and the refrigerant outlet header section (6). A flow-dividing resistance plate (29), which serves as partition means for dividing the interior of the refrigerant outlet header section (6) into an upper space and an lower space, integrally connects a lower end portion of the rear wall (26) of the second member (17) and a lower end portion of the partition wall (27) over the entire length thereof. A plurality of refrigerant passage holes (31A) and (31B) in a through-hole form and elongated in the left-right direction are formed in a rear region, excluding left and right end portions thereof, of the flow-dividing resistance plate (29) at predetermined intervals in the left-right direction. The lower end of the partition wall (27) projects downward beyond the lower ends of the front and rear walls (26). A plurality of projections (27*a*) are integrally formed on the lower end face of the partition wall (27) at predetermined intervals in the left-right direction in such a manner as to project downward, and are fitted into corresponding through holes (25) of the first member (16). The projections (27*a*) are formed by cutting off predetermined portions of the partition wall (27).

The left-hand closing member (18) includes, in an integrated fashion, a front cap (18*a*) for closing the left end opening of the refrigerant inlet header (5) and a rear cap (18*b*) for closing the left end opening of the refrigerant outlet header (6). A rightward projecting portion (39) to be fitted into the refrigerant inlet header section (5) is integrally formed on the front cap (18*a*). Similarly, an upper, rightward projecting portion (41) to be fitted into a space (6*a*) of the refrigerant outlet header section (6) located above the flow-dividing resistance plate (29) and a lower, rightward projecting portion (42) to be fitted into a space (6*b*) of the refrigerant outlet header section (6) located under the flow-dividing resistance plate (29) are integrally formed on the rear cap (18*b*) such that the projecting portions (41) and (42) are separated in the vertical direction. An engagement finger (43) projecting rightward is formed integrally with each of an arcuate portion extending between the front side edge and the top edge of the left-hand closing member (18) and an arcuate portion extending between the rear side edge and the top edge of the left-hand closing member (18). Further, an engagement finger (44) projecting rightward is formed integrally with each of a front portion and a rear portion of the lower edge of the left-hand closing member (18).

The right-hand closing member (19) includes, in an integrated fashion, a front cap (19*a*) for closing the right end opening of the refrigerant inlet header (5) and a rear cap (19*b*) for closing the right end opening of the refrigerant outlet header (6). A leftward projecting portion (32) to be fitted into the refrigerant inlet header section (5) is integrally formed on the front cap (19*a*). Similarly, an upper, leftward projecting portion (33) to be fitted into the space (6*a*) of the refrigerant outlet header section (6) located above the flow-dividing resistance plate (29) and a lower, leftward projecting portion (34) to be fitted into the space (6*b*) of the refrigerant outlet header section (6) located under the flow-dividing resistance plate (29) are integrally formed on the rear cap (19*b*) such that the projecting portions (33) and (34) are separated in the vertical direction. An engagement finger (35) projecting leftward is formed integrally with each of an arcuate portion extending between the front side edge and the top edge of the right-hand closing member (19) and an arcuate portion extending between the rear side edge and the top edge of the right-hand closing member (19). Further, an engagement finger (36) projecting leftward is formed integrally with each of a front portion and a rear portion of the lower edge of the right-hand closing member (19). A refrigerant inlet (37) is formed in the bottom wall of the leftward projecting portion (32) of the front cap (19*a*) of the right-hand closing member (19). A refrigerant outlet (38) is formed in the bottom wall of the upper, leftward projecting portion (33) of the rear cap (19*b*) of the right-hand closing member (19).

Each of the closing members (18) and (19) assumes a plate-like form, and assumes a shape such that two substantially arcuate portions are integrally connected together at a central position in the front-rear direction, so as to coincide with the corresponding left and right ends of the upper surface of the second member (17) of the refrigerant inlet/outlet tank (2). A flat portion is formed at a central portion (with respect to the front-rear direction) of the lower edge of each of the closing members (18) and (19) so as to coincide with the flat portion (24) of the first member (16).

The front curved portion (22) and the flat portion (24) of the first member (16), the front wall (26), the partition wall (27), and the front connection wall (28) of the second member (17), and the front caps (18*a*) and (19*a*) of the left-hand and right-hand closing members (18) and (19) form the refrigerant inlet header section (5). The rear curved portion (22) and the flat portion (24) of the first member (16), the rear wall (26), the partition wall (27), and the rear connection wall (28) of the second member (17), and the rear caps (18*b*) and (19*b*) of the left-hand and right-hand closing members (18) and (19) form the refrigerant outlet header section (6). The refrigerant inlet header section (5) and the refrigerant outlet header section (6) are united together via the flat portion (24), the partition wall (27), and the central portions of the closing members (18) and (19) with respect to the front-rear direction.

The joint plate (21) includes a short, cylindrical refrigerant inflow port (45) communicating with the refrigerant inlet (37) of the right-hand closing member (19), and a short, cylindrical refrigerant outflow port (46) communicating with the refrigerant outlet (38) of the right-hand closing member (19). A bent portion (47) projecting leftward is formed at a portion of each of the upper and lower edge portions of the joint plate (21) located between the refrigerant inflow port (45) and the refrigerant outflow port (46). The upper bent portion (47) is fitted between two substantially arcuate portions of the upper edge of the right-hand closing member (19) and is fitted between the two connection walls (28) of the second member (17). The lower bent portion (47) is fitted to the flat portion at the central portion (with respect to the front-rear direction) of the lower edge of the right-hand closing member (19) and to the flat portion (24) of the first member (16). An engagement finger (48) projecting leftward is formed integrally with each of front and rear end portions of the lower edge of the joint plate (21). The engagement fingers (48) are fitted to the lower edge of the right-hand closing member (19). A diameter-reduced portion formed at one end portion of the refrigerant inlet pipe (7) is inserted into and brazed to the refrigerant inflow port (45) of the joint plate (21). Similarly, a diameter-reduced portion formed at one end portion of the refrigerant outlet pipe (8) is inserted into and brazed to the refrigerant outflow port (46) of the joint plate (21). Although unillustrated, an expansion valve attachment member is joined to the other end portions of the refrigerant inlet and outlet pipes (7) and (8) while facing the ends of the pipes (7) and (8).

The first and second members (16) and (17) of the refrigerant inlet/outlet tank (2), the closing members (18) and (19), and the joint plate (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) are fitted to corresponding lower end portions of the front and rear walls (26) of the second member (17). In the thus-established condition, the first and second members (16) and (17) are brazed together by utilization of the brazing material layers of the first member (16). In attachment of the closing members (18) and (19), the front projecting portions (39) and (32) are fitted into the space defined by the first and second members (16) and (17) and located frontward of the partition wall (27); the rear, upper projecting portions (41) and (33) are fitted into the space defined by the first and second members (16) and (17) and located rearward of the partition wall (27) and above the flow-dividing resistance plate (29); the rear, lower projecting portions (42) and (34) are fitted into the space defined by the first and second members (16) and (17) and located rearward of the partition wall (27) and under the flow-dividing resistance plate (29); the upper engagement fingers (43) and (35) are fitted to the connection walls (28) of the second member (17); and the lower engagement fingers (44) and (36) are fitted to the curved portions (22) of the first member (16). In the thus-established condition, the closing members (18) and (19) are brazed to the first and second members (16) and (17) by utilization of the brazing material layers thereof. In attachment of the joint plate (21), the bent portions (47) are fitted to the right-hand closing member (19) and the second member (17), and the engagement fingers (48) are fitted to the right-hand closing member (19). In the thus-established condition, the joint plate (21) is brazed to the right-hand closing member (19) by utilization of the brazing material layers of the right-hand closing member (19).

The refrigerant inlet/outlet tank (2) is thus formed. The flow-dividing resistance plate (29) divides the interior of the refrigerant outlet header section (6) into the upper and lower spaces (6*a*) and (6*b*). The spaces (6*a*) and (6*b*) communicate with each other through the refrigerant passage holes (31A) and (31B). The refrigerant outlet (38) of the right-hand closing member (19) communicates with the upper space (6*a*) of the refrigerant outlet header section (6).

As shown in FIG. 3 and FIGS. 5 to 9, the refrigerant turn tank (3) is formed from an aluminum brazing sheet having a brazing material layer on each of opposite sides thereof and includes a first member (50) having a plate-like shape and to which all the heat exchange tubes (12) are connected; a second member (51) formed from a bare aluminum extrudate and covering the lower side of the first member (50); closing members (52) and (53) formed from an aluminum brazing sheet having a brazing material layer on each of opposite sides thereof, and closing the left and right end openings of the first and second members (50) and (51); an auxiliary drain plate (54) formed from an aluminum bare material, elongated in the left-right direction, and joined to the connection section (10); and a communication member (55) formed from an aluminum bare material, elongated in the front-rear direction, and brazed to the outer surface of the right-hand closing member (52) in such a manner as to face the ends of the refrigerant inflow intermediate header section (9) and the refrigerant outflow intermediate header section (11). The refrigerant inflow intermediate header section (9) and the refrigerant outflow intermediate header section (11) communicate with each other at their right end portions via the communication member (55).

Each of the refrigerant inflow intermediate header section (9) and the refrigerant outflow intermediate header section (11) has a top face, a front side face, a rear side face, and a bottom face. The top faces, excluding their inside and outside portions with respect to the front-rear direction, of the header sections (9) and (11) serve as horizontal flat faces (9*a*) and (11*a*), respectively. The inside portions with respect to the front-rear direction of the top faces of the header sections (9) and (11) serve as first low portions (9*b*) and (11*b*), respectively, which are of faces inclined linearly downward and toward the inside with respect to the front-rear direction. The first low portions (9*b*) and (11*b*) serve as front and rear side surfaces of the drain gutter (20). The front and rear side surfaces of the drain gutter (20) fan out upward and in the front-rear direction. Preferably, the first low portions (9*b*) and (11*b*) are inclined downward at an angle of 45 degrees or greater with respect to a horizontal plane. The front and rear side surfaces of the drain gutter (20); i.e., the first low portions (9*b*) and (11*b*) of the header sections (9) and (11), are not necessarily inclined linearly, but may be curved, so long as they fan out upward and in the front-rear direction. Outside portions with respect to the front-rear direction of the top faces of the header sections (9) and (11) serve as second low portions (9*c*) and (11*c*), respectively, which are of faces inclined linearly downward and toward the outside with respect to the front-rear direction. Preferably, the second low portions (9*c*) and (11*c*) are inclined downward at an angle of 45 degrees or greater with respect to a horizontal plane. The front and rear outside surfaces of the header sections (9) and (11) are connected to the corresponding second low portions (9*c*) and (11*c*) of the top faces.

The first member (50) includes a first header formation portion (56), which forms an upper portion of the refrigerant inflow intermediate header section (9); a second header formation portion (57), which forms an upper portion of the refrigerant outflow intermediate header section (11); and a connection wall (58), which connects the header formation portions (56) and (57) and forms the connection section (10). The first header formation portion (56) includes a horizontal flat top wall (56*a*); a first inclined wall (56*b*), which is formed integrally with the rear edge of the top wall (56*a*) over the entire length thereof and inclined rearward and downward; a second inclined wall (56*c*), which is formed integrally with the front edge of the top wall (56*a*) over the entire length thereof and inclined frontward and downward; and a vertical wall (56*d*), which is formed integrally with the front edge of the second inclined wall (56*c*) over the entire length thereof. The second header formation portion (57) includes a horizontal flat top wall (57*a*); a first inclined wall (57*b*), which is formed integrally with the front edge of the top wall (57*a*) over the entire length thereof and inclined frontward and downward; a second inclined wall (57*c*), which is formed integrally with the rear edge of the top wall (57*a*) over the entire length thereof and inclined rearward and downward; and a vertical wall (57*d*), which is formed integrally with the rear edge of the second inclined wall (57*c*) over the entire length thereof. The connection wall (58) integrally connects the lower edge of the first inclined wall (56*b*) of the first header formation portion (56) and the lower edge of the first inclined wall (57*b*) of the second header formation portion (57). The bottom end faces of the vertical walls (56*d*) and (57*d*) of the header formation portions (56) and (57), respectively, are inclined downward, and inward with respect to the front-rear direction. An outside portion of each of the bottom faces partially forms a stepped portion (69), which will be described later. The upper surface of the top wall (56*a*) of the first header formation portion (56) serves as the top face of the refrigerant inflow intermediate header section (9); i.e., as the horizontal flat face (9*a*); the outer surfaces of the inclined walls (56*b*) and (56*c*) serve as the low portions (9*b*) and (9*c*); and the outer surface of the vertical wall (56*c*) serves as an upper portion of the front surface of the refrigerant inflow intermediate header section (9). The upper surface of the top wall (57*a*) of the second header formation portion (57) serves as the top face of the refrigerant outflow intermediate header section (11); i.e., as the horizontal flat face (11*a*); the upper surfaces of the inclined walls (57*b*) and (57*c*) serve as the low portions (11*b*) and (11*c*); and the outer surface of the vertical wall (57*d*) serves as an upper portion of the rear surface of the refrigerant outflow intermediate header section (11).

A plurality of tube insertion holes (59) elongated in the front-rear direction are formed in the header formation portions (56) and (57) of the first member (50) at predetermined intervals in the left-right direction. The tube insertion holes (59) of the header formation portion (56) and those of the header formation portion (57) are identical in position in the left-right direction. End portions, located on a side toward the connection section (10), of the tube insertion holes (59); i.e., rear end portions of the tube insertion holes (59) of the first header formation portion (56) and front end portions of the tube insertion holes (59) of the second header formation portion (57), are located in the first inclined walls (56*b*) and (57*b*), respectively. Thus, the end portions, located on the side toward the connection section (10), of the tube insertion holes (59) are located in the side surfaces of the drain gutter (20). Outer end portions, with respect to the front-rear direction, of the tube insertion holes (59); i.e., front end portions of the tube insertion holes (59) of the first header formation portion (56) and rear end portions of the tube insertion holes (59) of the second header formation portion (57), are located in the second inclined walls (56*c*) and (57*c*), respectively. Thus, the front and rear end portions of the tube insertion holes (59) are located in the second low portions (9*c*) and (11*c*) of the top faces of the header sections (9) and (11).

In the top walls (56*a*) and (57*a*) and the inclined walls (56*b*), (56*c*), (57*b*), and (57*c*) of the header formation portions (56) and (57) of the first member (50), their portions located on the left and right sides of each tube insertion hole (59) serve as inclined portions (61) which are inclined downward and toward the tube insertion hole (59). The inclined portions (61) located on the left and right sides of each tube insertion hole (59) define a recess (62) (see FIG. 10). Drain grooves (63) for draining condensed water downward of the refrigerant turn tank (3) are formed, in connection with the front and rear end portions of the corresponding tube insertion holes (59), on the outer surfaces of the second inclined walls (56*c*) and (57*c*) and the vertical walls (56*d*) and (57*d*) of the header formation portions (56) and (57) of the first member (50). The bottom of each drain groove (63) extends downward as the distance from the corresponding tube insertion hole (59) increases. The bottom of a portion of each drain groove (63) located on the second inclined wall (56*c*) or (57*c*); i.e., on the second low portion (9*c*) or (11*c*), is linearly inclined, with respect to a horizontal plane, downward and toward the front or the rear. Preferably, the bottom of the portion of each drain groove (63) located on the second low portion (9*c*) or (11*c*) is inclined at an angle of 45 degrees or greater with respect to the horizontal plane. The lower end of a portion of each drain groove (63) located on the vertical wall (56*d*) or (57*d*) opens at the bottom end face of the vertical wall (56*d*) or (57*d*).

A plurality of drain through-holes (64) elongated in the left-right direction are formed in the connection wall (58) of the first member (50) at predetermined intervals in the left-right direction. Also, a plurality of fixation though-holes (65) are formed in the connection wall (58) of the first member (50) at predetermined intervals in the left-right direction while being shifted from the drain through-holes (64).

The second member (51) includes a first header formation portion (66), which forms a lower portion of the refrigerant inflow intermediate header section (9); a second header formation portion (67), which forms a lower portion of the refrigerant outflow intermediate header section (11); and a connection wall (68), which connects together the header formation portions (66) and (67) and is brazed to the connection wall (58) of the first member (50) to thereby form the connection section (10). The first header formation portion (66) includes vertical front and rear walls (66*a*), and a bottom wall (66*b*) integrally connecting the bottom ends of the front and rear walls (66*a*), projecting downward, and having a substantially arcuate cross section. The second header formation portion (67) includes vertical front and rear walls (67*a*); a bottom wall (67*b*) integrally connecting the bottom ends of the front and rear walls (67*a*), projecting downward, and having a substantially arcuate cross section; and a horizontal flow-dividing control wall (67*c*) (flow-dividing control means) integrally connecting upper end portions of the front and rear walls (67*a*). The connection wall (68) integrally connects an upper end portion of the rear wall (66*a*) of the first header formation portion (66) and an upper end portion of the front wall (67*a*) of the second header formation portion (67). The outer surface of the front wall (66*a*) of the first header formation portion (66) and the outer surface of the rear wall (67*a*) of the second header formation portion (67) are located inward, with respect to the front-rear direction, of the outer surface of the vertical wall (56*d*) of the first header formation portion (56) and the outer surface of the vertical wall (57*d*) of the second header formation portion (57), respectively, of the first member (50). Thus, the stepped portion (69) is provided at each of joint portions between the vertical walls (56*d*) and (57*d*) of the first member (50) and the front and rear walls (66*a*) and (67*a*) of the second member (51); the outer surfaces of the vertical walls (56*d*) and (57*d*) are located outward, with respect to the front-rear direction, of the outer surfaces of the front and rear walls (66*a*) and (67*a*), respectively, via the corresponding stepped portions (69); and the entire bottom end of each drain groove (63) opens at the corresponding stepped portion (69) (see FIG. 3). The outer surface of an upper edge portion of the front wall (66*a*) of the first header formation portion (66) is flush with the bottom surface of a portion of the drain groove (63) located on the vertical wall (56*d*), and the outer surface of an upper edge portion of the rear wall (67*a*) of the second header formation portion (67) is flush with the bottom surface of a portion of the drain groove (63) located on the vertical wall (57*d*). The outer surface of the front wall (66*a*) of the first header formation portion (66) serves as a lower portion of the front surface of the refrigerant inflow intermediate header section (9). The outer surface of the rear wall (67*a*) of the second header formation portion (67) serves as a lower portion of the rear surface of the refrigerant outflow intermediate header section (11).

A plurality of circular refrigerant passage holes (71) in a through-hole form are formed in a rear region of the flow-dividing control wall (67*c*) of the second header formation portion (67) of the second member (51) at predetermined intervals in the left-right direction. The distance between the two adjacent circular refrigerant passage holes (71) increases gradually with an increase in the distance from the right end of the second header formation portion (67); i.e., the communication portion between the refrigerant inflow intermediate header section (9) and the refrigerant outflow intermediate header section (11). Notably, the distance between the two adjacent circular refrigerant passage holes (71) may be constant. A plurality of drain through holes (72) elongated in the left-right direction are formed in the connection wall (68) of the second member (51), in alignment with the corresponding drain through-holes (64) of the first member (50). Also, a plurality of fixation through-holes (73) are formed in the connection wall (68), in alignment with the corresponding fixation through-holes (65) of the first member (50).

Cutouts (74) are formed in the auxiliary drain plate (54) in such a manner as to extend from its upper edge and to correspond to the drain through-holes (64) and (72) of the first and second members (50) and (51). The width of an open portion of the cutout (74) as measured in the left-right direction is equal to the length of the drain through-holes (64) and (72) as measured in the left-right direction. Auxiliary drain grooves (75) are formed on the front and rear surfaces of the auxiliary drain plate (54) as follows: the auxiliary drain grooves (75) extend vertically and are connected to the corresponding lower end portions of the cutouts (74); and their lower end portions are open at the bottom face of the auxiliary drain plate (54). Projections (76) are formed at the top edge of the auxiliary drain plate (54) in such a manner as to align with the corresponding fixation through-holes (65) and (73) of the first and second members (50) and (51) and to project upward so as to be inserted into the corresponding fixation through-holes (65) and (73).

The right-hand closing member (52) includes, in an integrated fashion, a front cap (52*a*) for closing the right end opening of the refrigerant inflow intermediate header section (9) and a rear cap (52*b*) for closing the right end opening of the refrigerant outflow intermediate header section (11). A leftward projecting portion (77) to be fitted into the refrigerant inflow intermediate header section (9) is integrally formed on the front cap (52*a*). Similarly, an upper, leftward projecting portion (78) to be fitted into a space (11A) of the refrigerant outflow intermediate header section (11) located above the flow-dividing control wall (67*c*) and a lower, leftward projecting portion (79) to be fitted into a space (11B) of the refrigerant outflow intermediate header section (11) located under the flow-dividing control wall (67*c*) are integrally formed on the rear cap (52*b*) such that the projecting portions (78) and (79) are separated in the vertical direction. An engagement finger (81) projecting leftward is formed at an arcuate portion extending between the front side edge and the lower edge of the right-hand closing member (52), an arcuate portion extending between the rear side edge and the lower edge of the right-hand closing member (52), and a front portion and a rear portion of the upper edge of the right-hand closing member (52). Moreover, an engagement finger (82) projecting rightward is formed at central portions (with respect to the front-rear direction) of the upper and lower edges of the right-hand closing member (52). A refrigerant outflow opening (83) for causing refrigerant to flow out of the refrigerant inflow intermediate header section (9) is formed in the bottom wall of the leftward projecting portion (77) of the front cap (52*a*) of the right-hand closing member (52). Similarly, a refrigerant inflow opening (84) for causing refrigerant to flow into the portion of the refrigerant outflow intermediate header section (11) located under the flow-dividing control wall (67*c*) is formed in the bottom wall of the lower, leftward projecting portion (79) of the rear cap (52*b*) of the right-hand closing member (52).

A guide portion (80) is integrally formed at a lower portion of the circumferential edge portion of the refrigerant inflow opening (84) at the lower, leftward projecting portion (79) of the rear cap (52*b*) of the right-hand closing member (52) such that the guide portion (80) extends toward the interior of the refrigerant outflow intermediate header section (11) (leftward), while inclining or curving upward (in the present embodiment, curving upward). The guide portion (80) guides the refrigerant flowing into the portion of the refrigerant outflow intermediate header section (11) located under the flow-dividing control wall (67*c*) to flow upward (toward the flow-dividing control wall (67*c*)).

The left-hand closing member (53) includes, in an integrated fashion, a front cap (53*a*) for closing the left end opening of the refrigerant inflow intermediate header section (9) and a rear cap (53*b*) for closing the left end opening of the refrigerant outflow intermediate header section (11). A rightward projecting portion (85) to be fitted into the refrigerant inflow intermediate header section (9) is integrally formed on the front cap (53*a*). Similarly, an upper, rightward projecting portion (86) to be fitted into the space (11A) of the refrigerant outflow intermediate header section (11) located above the flow-dividing control wall (67*c*) and a lower, rightward projecting portion (87) to be fitted into the space (11B) of the refrigerant outflow intermediate header section (11) located under the flow-dividing control wall (67*c*) are integrally formed on the rear cap (53*b*) such that the projecting portions (86) and (87) are separated in the vertical direction. An engagement finger (88) projecting rightward is formed at an arcuate portion extending between the front side edge and the lower edge of the left-hand closing member (53), an arcuate portion extending between the rear side edge and the lower edge of the left-hand closing member (53), and a front portion and a rear portion of the upper edge of the left-hand closing member (53).

The communication member (55) is formed, by press work, from an aluminum bear material and assumes, as viewed from the right, a plate-like form identical with that of the right-hand closing member (52). A peripheral edge portion of the communication member (55) is brazed to the outer surface of the right-hand closing member (52). An outward bulging portion (89) is formed on the communication member (55) so as to establish communication between the refrigerant outflow opening (83) and the refrigerant inflow opening (84) of the right-hand closing member (52). The interior of the outward bulging portion (89) serves as a communication channel (91) for establishing communication between the refrigerant outflow opening (83) and the refrigerant inflow opening (84) of the right-hand closing member (52). A cutout (92) is formed on each of the upper and lower edges of the communication member (55) at a central position with respect to the front-rear direction. The engagement fingers (82) of the right-hand closing member (52) are fitted into the corresponding cutouts (92).

In assembly of the refrigerant turn tank (3), the first and second members (50) and (51), the auxiliary drain plate (54), the closing members (52) and (53), and the communication member (55) are brazed together as follows. In assembly of the first member (50) and the second member (51), the connection walls (58) and (68) are brought in contact with each other such that the drain through-holes (64) and (72) are aligned with each other and such that the fixation through-holes (65) and (73) are aligned with each other; the bottom ends of the vertical walls (56*d*) and (57*d*) of the header formation portions (56) and (57) are engaged with the corresponding top ends of the front wall (66*a*) of the first header formation portion (66) and the rear wall (67*a*) of the second header formation portion (67); and the projections (76) of the auxiliary drain plate (54) are inserted into the fixation through-holes (65) and (73) of the members (50) and (51) and then crimped, thereby tacking the members (50) and (51) together. In the thus-established condition, these members are brazed together by utilization of the brazing material layers of the first member (50). The auxiliary drain plate (54) is brazed to the connection walls (58) and (68) of the members (50) and (51) by utilization of the brazing material layers of the first member (50). In attachment of the closing members (52) and (53), the projecting portions (77) and (85) of the front caps (52*a*) and (53*a*) are fitted into the space defined by the first header formation portions (56) and (66) of the members (50) and (51); the upper projecting portions (78) and (86) of the rear caps (52*b*) and (53*b*) are fitted into the upper space defined by the second header formation portions (57) and (67) of the members (50) and (51) and located above the flow-dividing control wall (67*c*); the lower projecting portions (79) and (87) of the rear caps (52*b*) and (53*b*) are fitted into the lower space defined by the second header formation portions (57) and (67) of the members (50) and (51) and located under the flow-dividing control wall (67*c*); the upper engagement fingers (81) and (88) are fitted to the first member (50); and the lower engagement fingers (81) and (88) are fitted to the second member (51). In the thus-established condition, the closing members (52) and (53) are brazed to the first and second members (50) and (51) by utilization of the brazing material layers thereof. In attachment of the communication member (55), the communication member (55) is engaged with the right-hand closing member (52) such that the engagement fingers (82) of the right-hand closing member (52) are fitted into the corresponding cutouts (92). In the thus-established condition, the communication member (55) is brazed to the right-hand closing member (52) by utilization of the brazing material layers of the right-hand closing member (52).

The refrigerant turn tank (3) is thus formed. The first header formation portions (56) and (66) of the members (50) and (51) define the refrigerant inflow intermediate header section (9). The second header formation portions (57) and (67) define the refrigerant outflow intermediate header section (11). The flow-dividing control wall (67*c*) divides the interior of the refrigerant outflow intermediate header section (11) into the upper and lower spaces (11A) and (11B). The spaces (11A) and (11B) communicate with each other through the circular refrigerant passage holes (71). The upper space (11A) is a first space which the heat exchange tubes (12) face, and the lower space (11B) is a second space which communicates with the refrigerant inflow intermediate header section (9). The interior of the refrigerant inflow intermediate header section (9) communicates with the lower space (11B) of the refrigerant outflow intermediate header section (11) via the refrigerant outflow opening (83) of the front cap (52*a*) of the right-hand closing member (52), the communication channel (91) within the outward bulging portion (89) of the communication member (55), and the refrigerant inflow opening (84) of the rear cap (52*b*) of the right-hand closing member (52). The connection walls (58) and (68) of the members (50) and (51) define the connection section (10). The first low portion (9*b*) of the refrigerant inflow intermediate header section (9), the first low portion (11*b*) of the refrigerant outflow intermediate header section (11), and the connection section (10) define the drain gutter (20).

Each of the heat exchange tubes (12) is formed from a bare aluminum extrudate and assumes a flat form having a wide width in the front-rear direction. In the heat exchange tube (12), a plurality of refrigerant channels (12*a*) extending in the longitudinal direction thereof are formed in parallel therein. The outer surfaces of the front and rear end walls of the heat exchange tube (12) have an arcuate horizontal cross section such that a central portion thereof projects outward (see FIG. 6). The front heat exchange tubes (12) and the rear heat exchange tubes (12) are arranged in such a manner as to be identical in position in the left-right direction. Upper end portions of the heat exchange tubes (12) are inserted into the corresponding tube insertion holes (23) of the first member (16) of the refrigerant input/output tank (2) and are brazed to the first member (16) by utilization of the brazing material layers of the first member (16). Lower end portions of the heat exchange tubes (12) are inserted into the corresponding tube insertion holes (59) of the first member (50) of the refrigerant turn tank (3) and are brazed to the first member (50) by utilization of the brazing material layers of the first member (50). The front heat exchange tubes (12) communicate with the refrigerant inlet header section (5) and the refrigerant inflow intermediate header section (9). The rear heat exchange tubes (12) communicate with the refrigerant outlet header section (6) and the refrigerant outflow intermediate header section (11).

Preferably, the thickness of the heat exchange tube (12) as measured in the left-right direction; i.e., a tube height (h), is 0.75 mm to 1.5 mm (see FIG. 10); the width of the heat exchange tube (12) as measured in the front-rear direction is 12 mm to 18 mm; the wall thickness of the heat exchange tube (12) is 0.175 mm to 0.275 mm; the thickness of a partition wall separating the refrigerant channels (12*a*) from each other is 0.175 mm to 0.275 mm; the pitch of the partition walls is 0.5 mm to 3.0 mm; and the outer surfaces of the front and rear end walls each have a radius of curvature of 0.35 mm to 0.75 mm as measured on the outer surface thereof.

In place of use of the heat exchange tube (12) formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on each of opposite sides thereof is subjected to a rolling process so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls.

Each of the corrugated fins (14) is made in a wavy form from an aluminum brazing sheet having a brazing material layer over opposite surfaces thereof. The corrugate fin (14) includes wave crest portions (14*a*), wave trough portions (14*b*), and horizontal flat connection portions (14*c*) each connecting together the wave crest portion (14*a*) and the wave trough portion (14*b*) (see FIG. 10). A plurality of louvers are formed at the connection portions (14*c*) in such a manner as to be juxtaposed in the front-rear direction. The front and rear heat exchange tubes (12) which constitute a refrigerant flow member (13) share the corrugate fin (14). The width of the corrugate fin (14) as measured in the front-rear direction is approximately equal to the span between the front edge of the front heat exchange tube (12) and the rear edge of the rear heat exchange tube (12). The wave crest portions (14*a*) and the wave trough portions (14*b*) of the corrugate fin (14) are brazed to the front and rear heat exchange tubes (12).

The fin height (H) of the corrugate fin (14) means the direct distance between the wave crest portion (14*a*) and the wave trough portion (14*b*). Preferably, the fin height (H) is 7.0 mm to 10.0 mm. The fin pitch (Pf) of the corrugate fin (14) means ½the distance (P) between vertically central portions of adjacent wave crest portions (14*a*) or wave trough portion (14*b*); i.e., (Pf)=P/2. Preferably, the fin pitch (Pf) is 1.3 mm to 1.7 mm. Each of the wave crest portion (14*a*) and the wave trough portion (14*b*) of the corrugate fin (14) includes a flat portion, which is brazed in a surface contact condition to the flat tubes (12), and round portions, which are located at corresponding opposite ends of the flat portion and connected to the corresponding connection portions (14*c*). Preferably, the round portions have a radius (R) of curvature of 0.7 mm or less (see FIG. 10).

In manufacture of the evaporator (1), component members thereof excluding the refrigerant inlet pipe (7) and the refrigerant outlet pipe (8) are assembled and provisionally fixed together, and then all the component members are brazed together.

The evaporator (1), together with a compressor and a condenser (refrigerant cooler), constitutes a refrigeration cycle which is installed in a vehicle, such as an automobile, as a car air conditioner.

In the evaporator (1) described above, as shown in FIG. 11, two-phase refrigerant of vapor-liquid phase having passed through a compressor, a condenser, and an expansion valve enters the refrigerant inlet header section (5) of the refrigerant inlet/outlet tank (2) from the refrigerant inlet pipe (7) through the refrigerant inflow port (45) of the joint plate (21) and the refrigerant inlet (37) of the front cap (19*a*) of the right-hand closing member (19). Then, the refrigerant dividedly flows into the refrigerant channels (12*a*) of the front heat exchange tubes (12) of the front heat exchange tube group (13).

The refrigerant having entered the refrigerant channels (12*a*) of all the front heat exchange tubes (12) flows downward through the refrigerant channels (12*a*) and enters the refrigerant inflow intermediate header section (9) of the refrigerant turn tank (3). The refrigerant having entered the refrigerant inflow intermediate header section (9) flows rightward and then flows through the refrigerant outflow opening (83) of the front cap (52*a*) of the right-hand closing member (52), the communication channel (91) in the outward bulging portion (89) of the communication member (55), and the refrigerant inflow opening (84) of the rear cap (52*b*), thereby turning its flow direction and entering the lower space (11B) of the refrigerant outflow intermediate header section (11). Even when the distribution of temperature (dryness of refrigerant) of the refrigerant flowing through the front heat exchange tubes (12) becomes non-uniform due to a failure in the refrigerant flowing from the refrigerant inlet header section (5) to the front heat exchange tubes (12) in a uniformly divided condition, the refrigerant is mixed up when the refrigerant out flowing from the refrigerant inflow intermediate header section (9) turns its flow direction and flows into the lower space (11B) of the refrigerant outflow intermediate header section (11), so that its temperature becomes uniform.

The refrigerant having entered the lower space (11B) of the refrigerant outflow intermediate header section (11) flows leftward; enters the upper space (11A) through the circular refrigerant passage holes (71) of the flow-dividing control wall (67*c*); and dividedly flows into the refrigerant channels (12*a*) of all of the rear heat exchange tubes (12). At this time, the refrigerant is guided by the guide portion (80) to flow toward the upper left direction; i.e., toward the lower space (11B) while curving toward the flow-dividing control wall (67*c*) (see the arrow Y in FIGS. 2 and 8). As a result of the above, coupled with the gradual increase in the distance between the two adjacent circular refrigerant passage holes (71) formed in the flow-dividing control wall (67*c*) increases gradually with an increase in the distance from the right end, the refrigerant flowing into the upper space (11A) via the refrigerant passage holes (71) becomes uniform in terms of distribution in the left-right direction, as compared with the case where the guide portion (80) is not provided. Accordingly, the refrigerant becomes more likely to uniformly flow into the heat exchange tubes (12) connected to the refrigerant outflow intermediate header section (11). Thus, the distribution of refrigerant in the heat exchange core section (4) is less likely to become non-uniform, and the temperature of air having passed through the heat exchange core section (4) becomes uniform, whereby the heat exchange performance is improved.

The refrigerant having flown into the refrigerant channels (12*a*) of the heat exchange tubes (12) flows upward, in opposition to the previous flow direction; enters the lower space (6*b*) of the refrigerant outlet header section (6); and enters the upper space (6*a*) through the elongated refrigerant passage holes (31A) and (31B) of the flow-dividing resistance plate (29). Since the flow-dividing control wall (29) imparts resistance to the flow of the refrigerant, the divided flow from the upper space (11A) of the refrigerant outflow intermediate header section (11) to the rear heat exchange tubes (12) becomes uniform, and the divided flow from the refrigerant inlet header section (5) to the front heat exchange tubes (12) becomes uniform to a greater extent. As a result, the refrigerant flow rate becomes uniform among all the heat exchange tubes (12), so that the temperature distribution throughout the heat exchange core section (4) becomes uniform.

Next, the refrigerant having entered the upper space (6*a*) of the refrigerant outlet header section (6) flows out to the refrigerant outlet pipe (8) through the refrigerant outlet (38) of the rear cap (19*b*) of the right-hand closing member (19) and the refrigerant outflow port (46) of the joint plate (21). While flowing through the refrigerant channels (12*a*) of the front heat exchange tubes (12) and through the refrigerant channels (12*a*) of the rear heat exchange tubes (12), the refrigerant is subjected to heat exchange with the air flowing through the air-passing clearances in the direction of arrow X shown in FIGS. 1 and 11 and flows out from the evaporator (1) in a vapor phase.

At this time, condensed water is generated on the heat exchange tubes (12) and the surface of the corrugate fins (14), particularly, on the surface of the corrugate fins (14). The generated condensed water mostly flows, by the capillary effect, toward joint portions between the heat exchange tubes (12) and the wave crest portions (14*a*) of the corrugate fins (14) and toward joint portions between the heat exchange tubes (12) and the wave trough portions (14*b*) of the corrugate fins (14). The condensed water attracted to the connection portions between the rear heat exchange tubes (12) and the corrugate fins (14) is caused to flow frontward by the effect of air flowing through air-passing clearances each being formed between the heat exchange tubes (12) adjacent to each other in the left-right direction and is then drained downward along the front end surfaces of the rear heat exchange tubes (12). Meanwhile, the condensed water attracted to the connection portions between the front heat exchange tubes (12) and the corrugate fins (14) is caused to flow frontward by the effect of air flowing through air-passing clearances each being formed between the heat exchange tubes (12) adjacent to each other in the left-right direction and is then drained downward along the front end surfaces of the front heat exchange tubes (12).

The condensed water having been drained downward along the front end surfaces of the rear heat exchange tubes (12) enters the drain gutter (20) of the refrigerant turn tank (3). When the condensed water collected in the drain gutter (20) reaches a certain amount, the condensed water flows down the connection section (10) through the drain through-holes (64) and (72); flows along side edge portions of the cutouts (74) of the auxiliary drain plate (54); enters the auxiliary drain grooves (75); flows down in the auxiliary drain grooves (75); and drops downward below the refrigerant turn tank (3) from the bottom end openings of the auxiliary drain grooves (75). The condensed water having been drained downward along the front end surfaces of the front heat exchange tubes (12) enters the drain grooves (63); flows in the drain grooves (63); and drops downward below the refrigerant turn tank (3) from the bottom end openings of the drain grooves (63); i.e., from the openings of the stepped portions (69). Thus is drained away the generated condensed water.

In the above described embodiment, the evaporator according to the present invention is applied to an evaporator of a car air conditioner which uses a chlorofluorocarbon-based refrigerant. However, the present invention is not limited thereto. The evaporator of the present invention may be applied to an evaporator of a car air conditioner used in a vehicle, such as an automobile, the car air conditioner including a compressor, a gas cooler (refrigerant cooler), an intermediate heat exchanger, an expansion valve, and an evaporator, and using a supercritical refrigerant such as a $CO_2$ refrigerant.

In the above-described embodiment, a single heat exchange tube group (13) is provided between the refrigerant inlet header section (5) and the refrigerant inflow intermediate header section (9) of the tanks (2) and (3) and between the refrigerant outlet header section (6) and the refrigerant outflow intermediate header section (11) of the tanks (2) and (3). However, the present invention is not limited thereto. A single or two or more heat exchange tube groups (13) may be provided between the refrigerant inlet header section (5) and the refrigerant inflow intermediate header section (9) of the tanks (2) and (3) and between the refrigerant outlet header section (6) and the refrigerant outflow intermediate header section (11) of the tanks (2) and (3). In the above-described embodiment, the refrigerant inlet/outlet tank (2) is disposed on the upper side, and the refrigerant turn tank (3) is disposed on the lower side. However, in some cases, the refrigerant inlet/outlet tank (2) is disposed on the lower side, and the refrigerant turn tank (3) is disposed on the upper side.

In the above-described embodiment, the evaporator (1) includes the refrigerant inlet header section (5), the refrigerant outlet header section (6), the refrigerant inflow intermediate header section (9), and the refrigerant outflow intermediate header section (11). However, instead of this structure, a structure as that of the evaporator disclosed in Patent Document 1 may be employed. That is, the evaporator (1) may includes a refrigerant inlet header section which are disposed on the upper-end side of the heat exchange tubes and to which the left half of the heat exchange tubes of the front heat exchange tube group are connected; a refrigerant outlet header section which is disposed on the upper-end side of the heat exchange tubes to be located on the rear side of the refrigerant inlet header section and to which the left half of the heat exchange tubes of the rear heat exchange tube group are connected; a first intermediate header section which is disposed on the lower-end side of the heat exchange tubes and to which the heat exchange tubes of the heat exchange tube group connected to the refrigerant inlet header section are connected; a second intermediate header section which is disposed on the right side of the first intermediate header section and to which the remaining heat exchange tubes of the front heat exchange tube group are connected; a third intermediate header section which is disposed on the upper-end side of the heat exchange tubes to be located on the right side of the refrigerant inlet header section and to which the heat exchange tubes connected to the second intermediate header section are connected; a fourth intermediate header section which is disposed on the upper-end side of the heat exchange tubes to be located on the rear side of the third intermediate header section and to which the remaining heat exchange tubes of the rear heat exchange tube group are connected; a fifth intermediate header section which is disposed on the lower-end side of the heat exchange tubes to be located on the rear side of the second intermediate header section and to which the heat exchange tubes connected to the fourth intermediate header section are connected; and a sixth fifth intermediate header section which is disposed on the lower-end side of the heat exchange tubes to be located on the left side of the fifth intermediate header section and to which the heat exchange tubes connected to the refrigerant outlet header section are connected. Refrigerant which flows into the refrigerant inlet header section passes through the heat exchange tubes and the first through sixth header sections, flows into the refrigerant outlet header section, and then flows out of the refrigerant outlet header section. In such an evaporator, a guide portion for guiding upward the refrigerant flowing into the second and sixth intermediate header sections is provided at each of refrigerant-inflow-side end portions of the second and sixth intermediate header sections. In the above-described evaporator, in some cases, communication is established between the third intermediate header section and the fourth intermediate header section at their end portions opposite the refrigerant inlet header section and the refrigerant outlet header section. In such a case, refrigerant flows into the fourth intermediate header section from one end thereof. Therefore, a guide portion for guiding upward the refrigerant flowing into the fourth intermediate header section is provided at a refrigerant-inflow-side end portion of the fourth intermediate header section.

In the above-described embodiment, the heat exchanger according to the present invention is applied to an evaporator. However, the present invention is not limited thereto.

INDUSTRIAL APPLICABILITY

The heat exchanger according to the present invention is preferably used as an evaporator of a car air conditioner, which is a refrigeration cycle mounted on an automobile.

The invention claimed is:

1. A heat exchanger comprising:

a refrigerant inlet header section and a refrigerant outlet header section which are positioned in parallel in a front-rear direction;

a refrigerant circulation passage establishing communication between the header sections; and a heat exchange core section configured such that heat exchange tube groups each having a plurality of heat exchange tubes positioned at intervals are provided in a plurality of rows in the front-rear direction, wherein the refrigerant circulation passage comprises a plurality of intermediate header sections and a plurality of heat exchange tubes; the refrigerant inlet header section faces a first intermediate header section; the refrigerant outlet header section faces a second intermediate header section; at least a single heat exchange tube group comprising a plurality of heat exchange tubes disposed at intervals is disposed between the refrigerant inlet header section and the first intermediate header section and between the refrigerant outlet header section and the second intermediate header section; opposite end portions of the heat exchange tubes of each heat exchange tube group are connected to the corresponding header sections facing each other; refrigerant flowing into the refrigerant inlet header section passes through the refrigerant circulation passage, and returns to the refrigerant outlet header section to be fed out from the refrigerant outlet header section; and the refrigerant flows into at least one intermediate header section from one longitudinal end thereof, wherein a guide portion is provided at a refrigerant-inflow-side end portion of the second intermediate header section into which the refrigerant flows from the longitudinal end thereof, so as to guide the refrigerant flowing into the second intermediate header section to flow upward, wherein the refrigerant inlet header section is disposed on a first-end side of the heat exchange tubes, and the heat exchange tubes of at least one heat exchange tube group are connected to the refrigerant inlet header section; the refrigerant outlet header section is disposed on the first-end side of the heat exchange tubes to be located rearward of the refrigerant inlet header section, and the heat exchange tubes of the remaining heat exchange tube group(s) are connected to the refrigerant outlet header section; the first intermediate header section is disposed on a second-end side of the heat exchange tubes, and the heat exchange tubes connected to the refrigerant inlet header section are connected to the first intermediate header section; the second intermediate header section is disposed on the second-end side of the heat exchange tubes to be located rearward of the first intermediate header section, and the heat exchange tubes connected to the refrigerant outlet header section are connected to the second intermediate header section; communication is established between the first intermediate header section and the second intermediate header section at ends thereof; the refrigerant is caused to flow into the second intermediate header section from an end portion thereof which communicates with the first intermediate header section; and the guide portion guiding the refrigerant flowing into the second intermediate header section to flow upward is provided at the refrigerant-inflow-side end portion of the second intermediate header section, wherein flow-dividing control means having a refrigerant passage hole and vertically dividing the interior of the second intermediate header section into first and second spaces is provided within the second intermediate header section; the heat exchange tubes connected to the second intermediate header section face the first space; communication is established between the first intermediate header section and the second space of the second intermediate header section; and the guide portion provided at the refrigerant-inflow-side end portion of the second intermediate header section guides the refrigerant flowing into the second space of the second intermediate header section to flow upward.

2. A heat exchanger according to claim 1, wherein a plurality of refrigerant passage holes are formed in the flow-dividing control means at intervals with respect to the longitudinal direction of the second intermediate header section.

3. A heat exchanger according to claim 2, wherein the refrigerant passage holes are formed in the flow-dividing control means located on a rear side with respect to the front-rear direction.

4. A heat exchanger according to claim 1, wherein the refrigerant inlet header section and the refrigerant outlet header section are disposed on the upper-end side of the heat exchange tubes, and the first and second intermediate header sections are disposed on the lower-end side of the heat exchange tubes.

5. A heat exchanger according to claim 1, wherein each of the first and second intermediate header sections has caps for closing the opposite ends thereof; a refrigerant outflow opening is formed in one of the caps at one end of the first intermediate header section; a refrigerant inflow opening is formed in one of the caps at one end of the second intermediate header section; and communication is established between the refrigerant outflow opening and the refrigerant inflow opening via a communication member, whereby the two intermediate header sections communicate with each other at ends thereof.

6. A heat exchanger according to claim 5, wherein the guide portion is provided at a portion of a circumferential edge portion of the refrigerant inflow opening formed in the cap at the end of the second intermediate header section such that the guide portion extends toward the interior of the second intermediate header section while inclining or curving upward.

7. A heat exchanger according to claim 6, wherein the guide portion extends toward the interior of the second intermediate header section while curving upward, and the guide portion has an accurate portion which extends toward the interior of the second intermediate header section while curving upward, in a cross section taken along a vertical plane extending along the longitudinal direction of the second intermediate header section.

8. A heat exchanger according to claim 5, wherein the cap of the first intermediate header section in which the refrigerant inflow opening is formed and the cap of the second intermediate header section in which the refrigerant outflow opening is formed are integrated with each other, and the communication member is fixed to the caps such that the communication member extends over both the caps.

9. A heat exchanger according to claim 1, wherein a refrigerant inlet is formed at one end portion of the refrigerant inlet header section, and a refrigerant outlet is formed at an end portion of the refrigerant outlet header section to be located on the same side as the end portion where the refrigerant inlet is formed.

10. A heat exchanger according to claim 9, wherein the interior of the refrigerant outlet header section is vertically divided into first and second spaces by partitioning means; the heat exchange tubes are connected to the refrigerant outlet header section to face the first space; a refrigerant passage hole is formed in the partitioning means; and the second space of the refrigerant outlet header section communicates with the refrigerant outlet.

11. A heat exchanger according to claim 1, wherein the heat exchange tubes are each in a flat form and are arranged such that widths thereof extend in the front-rear direction, and a tube height, which is a thickness of the individual heat exchange tubes, is 0.75 mm to 1.5 mm.

12. A heat exchanger according to claim 1, wherein a fin is disposed between adjacent heat exchange tubes; the fin is in a corrugate form and comprises wave crest portions, wave trough portions, and flat connection portions connecting together the wave crest portions and the wave trough portions; and the fin has a fin height of 7.0 mm to 10.0 mm and a fin pitch of 1.3 mm to 1.7 mm.

13. A heat exchanger according to claim 12, wherein each of the wave crest portions and the wave trough portions of the corrugate fin comprises a flat portion, and round portions located at corresponding opposite ends of the flat portion and connected to the corresponding connection portions; and the round portions have a radius of curvature of 0.7 mm or less.

14. A heat exchanger according to claim 1, wherein the flow-dividing control means comprises a flow-dividing control wall.

15. A heat exchanger according to claim 14, wherein a plurality of refrigerant passage holes are formed in the flow-dividing control wall at intervals with respect to the longitudinal direction of the second intermediate header section.

16. A heat exchanger according to claim 15, wherein the refrigerant passage holes are formed in the flow-dividing control wall located on a rear side with respect to the front-rear direction.

17. A heat exchanger according to claim 10, wherein the partitioning means comprises a partition wall.

* * * * *